US008684493B2

(12) United States Patent
Tajima et al.

(10) Patent No.: US 8,684,493 B2
(45) Date of Patent: Apr. 1, 2014

(54) DROPLET-DISCHARGING-HEAD MANUFACTURING APPARATUS, DROPLET-DISCHARGING-HEAD MANUFACTURING METHOD, DROPLET DISCHARGING HEAD, DROPLET DISCHARGING DEVICE, AND PRINTING APPARATUS

(75) Inventors: Yukitoshi Tajima, Kanagawa (JP); Keiji Ueda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 13/419,800

(22) Filed: Mar. 14, 2012

(65) Prior Publication Data

US 2012/0236067 A1 Sep. 20, 2012

(30) Foreign Application Priority Data

Mar. 15, 2011 (JP) ..... 2011-057143

(51) Int. Cl.
*B41J 2/015* (2006.01)

(52) U.S. Cl.
USPC ..... 347/20

(58) Field of Classification Search
USPC ..... 347/20
See application file for complete search history.

(56) References Cited

U.S. PATENT DOCUMENTS 3,842,794 A * 10/1974 Ing ..... 118/724
5,777,743 A * 7/1998 Bacchi et al. ..... 356/370
5,951,770 A * 9/1999 Perlov et al. ..... 118/719
2010/0302323 A1 12/2010 Yagi et al.
2010/0315471 A1 12/2010 Kihira et al.

FOREIGN PATENT DOCUMENTS

| | | | |
|---|---|---|---|
| JP | 3387380 | | 1/2003 |
| JP | 3592053 | | 9/2004 |
| JP | 2005-26517 | | 1/2005 |
| JP | 2005-183543 | | 7/2005 |
| JP | 2005183543 | A * | 7/2005 |
| JP | 2005-327920 | | 11/2005 |
| JP | 3888459 | | 12/2006 |

* cited by examiner

*Primary Examiner* — Matthew Luu
*Assistant Examiner* — Michael Konczal
(74) *Attorney, Agent, or Firm* — Cooper & Dunham LLP

(57) ABSTRACT

A droplet-discharging-head manufacturing apparatus that manufactures a droplet discharging head that includes a piezoelectric element formed by a laminated body of ferroelectric layers includes: a film forming unit that forms a ferroelectric precursor film on a silicon wafer having a conductive layer; a heating unit that heats and bakes the ferroelectric precursor layer to form the ferroelectric layer; a cooling unit that cools the ferroelectric layer; a conveying unit that conveys the silicon wafers one by one; and a control unit that controls the film forming unit, the heating unit, the cooling unit, and the conveying unit so as to repeat a series of processes including formation of the ferroelectric precursor layers by the film forming unit, heating of the ferroelectric precursor layers by the heating unit, and cooling of the ferroelectric layers by the cooling unit, for a predetermined number of times for each of the silicon wafers.

13 Claims, 14 Drawing Sheets

DROPLET-DISCHARGING-HEAD MANUFACTURING APPARATUS, DROPLET-DISCHARGING-HEAD MANUFACTURING METHOD, DROPLET DISCHARGING HEAD, DROPLET DISCHARGING DEVICE, AND PRINTING APPARATUS

CROSS-REFERENCE TO RELATED APPLICATIONS

The present application claims priority to and incorporates by reference the entire contents of Japanese Patent Application No. 2011-057143 filed in Japan on Mar. 15, 2011.

BACKGROUND OF THE INVENTION

1. Field of the Invention

The present invention relates to a droplet-discharging-head manufacturing apparatus, a droplet-discharging-head manufacturing method, a droplet discharging head, a droplet discharging device, and a printing apparatus.

2. Description of the Related Art

A droplet discharging head provided in a droplet discharging device of an inkjet recording apparatus used as an image recording apparatus or an image forming apparatus, such as a printer, a facsimile machine, or a copying machine, includes a nozzle for discharging ink droplets; a pressurizing chamber (also referred to as an ink flow path, a pressurizing liquid chamber, a pressure chamber, a discharge chamber, or a liquid chamber) communicating with the nozzle; and a piezoelectric element that pressurizes ink in the pressurizing chamber. A voltage is applied to the piezoelectric element so as to generate energy through which a diaphragm is displaced to pressurize ink in the pressurizing chamber, thereby discharging ink droplets from the nozzle.

As the piezoelectric element, there are known types including a longitudinal vibration type using displacement in the d33 direction and a lateral vibration type (may be referred to as a bending mode) using displacement in the d31 direction. Of the above types, a thin-film piezoelectric element is known, in which a pressurizing chamber including a diaphragm is formed on a Si substrate, and a piezoelectric body of the lateral vibration type is directly formed on the surface of the diaphragm by using a semiconductor process or a micro electro mechanical systems (MEMS) technology so as to form high-definition images.

The piezoelectric element as described above is formed such that a constituent material having a ferroelectric property is deposited on a lower electrode on the surface of a silicon wafer by using a known film formation technology, such as various vacuum film formation methods, a sol-gel method, a hydrothermal synthesis method, an aerosol deposition (AD) method, or a coating-pyrolysis method, to form a ferroelectric layer with a desired thickness, and thereafter, an upper electrode layer is formed thereon. Then, the piezoelectric element is cut into a desired shape by using a lithography method or the like to form independent piezoelectric elements for respective pressurizing chambers. The silicon wafer on which a plurality of piezoelectric elements is formed is cut along a dicing line so as to be divided into a plurality of silicon chips. Thereafter, various processing processes are performed on each of the silicon chips to manufacture a plurality of droplet discharging heads.

The ferroelectric layer as described above is formed such that, for example, a ferroelectric precursor film that is a coating film made with a ferroelectric precursor (a liquid containing a constituent material having a ferroelectric property) is formed by the sol-gel method or the like, and thereafter a heating process (crystallization through baking) is performed (see, for example, Japanese Patent No. 3387380).

Japanese Patent No. 3387380 discloses a method in which a plurality of silicon wafers, on which ferroelectric precursor films are formed, is fixed on a fixing jig. In the method disclosed in Japanese Patent No. 3387380, the fixing jig is inserted into a diffusion furnace at predetermined velocity to perform a heating and baking process on the silicon wafers fixed on the fixing jig, so that a ferroelectric layer is formed. Thereafter, the fixing jig is discharged from the diffusion furnace.

However, if the manufacturing method disclosed in Japanese Patent No. 3387380 is used, heat (the thermal history) applied to each of the silicon wafers during the heating and baking process varies. Therefore, the thermal history of the ferroelectric layer of a piezoelectric element varies between the silicon wafers, so that displacement of a diaphragm due to the displacement of the piezoelectric element may vary. The variation in the displacement of the diaphragm may cause a variation in the discharging property of a droplet discharging head.

Therefore, a technology for preventing a variation in the thermal history of the ferroelectric layer between the silicon wafers is disclosed (see, for example, Japanese Patent Application Laid-open No. 2005-327920).

Japanese Patent Application Laid-open No. 2005-327920 discloses a technology in which a plurality of silicon wafers, on which ferroelectric precursor films are formed, are fixed on respective stages arranged in a row. In the technology disclosed in Japanese Patent Application Laid-open No. 2005-327920, the stages arranged in the row are inserted into a heating furnace in order from a stage on one end side and thereafter moved backward so as to be discharged from the heating furnace. Japanese Patent Application Laid-open No. 2005-327920 also discloses that the order of the stages is changed at every predetermined number of times.

However, in the technology disclosed in Japanese Patent Application Laid-open No. 2005-327920, the stages arranged in the row are inserted into the heating furnace in order from the stage on one end side and thereafter moved backward so as to be discharged from the heating furnace. Therefore, a staying duration in the heating furnace varies between a silicon wafer held by a stage that is firstly inserted into the heating furnace among the stages and a silicon wafer held by a stage that is lastly inserted into the heating furnace among the stages. Therefore, even when the order of the stages is changed, it may be difficult to prevent a variation in the thermal history of the ferroelectric film between the silicon wafers. Furthermore, the thermal history also varies between ferroelectric layers laminated on each of the silicon wafers.

Therefore, it is difficult to prevent a variation in the discharging property due to the variation in the thermal history of the ferroelectric layer between the droplet discharging heads.

The present embodiment has been made in view of the above and there is a need to provide a droplet-discharging-head manufacturing apparatus, a droplet-discharging-head manufacturing method, a droplet discharging head, a droplet discharging device, and a printing apparatus capable of preventing a variation in the discharging property between the droplet discharging heads.

SUMMARY OF THE INVENTION

It is an object of the present invention to at least partially solve the problems in the conventional technology.

A droplet-discharging-head manufacturing apparatus that manufactures a droplet discharging head that includes a piezoelectric element formed by a lower electrode, a piezoelectric body as a laminated body of a plurality of ferroelectric layers, and an upper electrode laminated in this order includes: a film forming unit that forms a ferroelectric precursor film on a silicon wafer having a conductive layer formed thereon; a heating unit that heats and bakes the ferroelectric precursor layer to form the ferroelectric layer; a cooling unit that cools the ferroelectric layer; a conveying unit that conveys a plurality of the silicon wafers one by one; and a control unit that controls the film forming unit, the heating unit, the cooling unit, and the conveying unit so as to repeat a series of processes including formation of the ferroelectric precursor layers by the film forming unit, heating of the ferroelectric precursor layers by the heating unit, and cooling of the ferroelectric layers by the cooling unit, for a predetermined number of times for each of the silicon wafers.

A droplet-discharging-head manufacturing method for manufacturing a droplet discharging head that includes a piezoelectric element formed by a lower electrode, a piezoelectric body as a laminated body of a plurality of ferroelectric layers, and an upper electrode laminated in this order includes: forming a ferroelectric precursor film on a silicon wafer having a conductive layer formed thereon; heating and baking the ferroelectric precursor layer to form the ferroelectric layer; cooling the ferroelectric layer; and repeating a series of processes including the forming, the heating, and the cooling, on each of the silicon wafers, for a predetermined number of times.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a droplet-discharging-head manufacturing apparatus and a droplet-discharging-head manufacturing method will be explained in detail below with reference to the accompanying drawings.

First Embodiment

Figure 1:
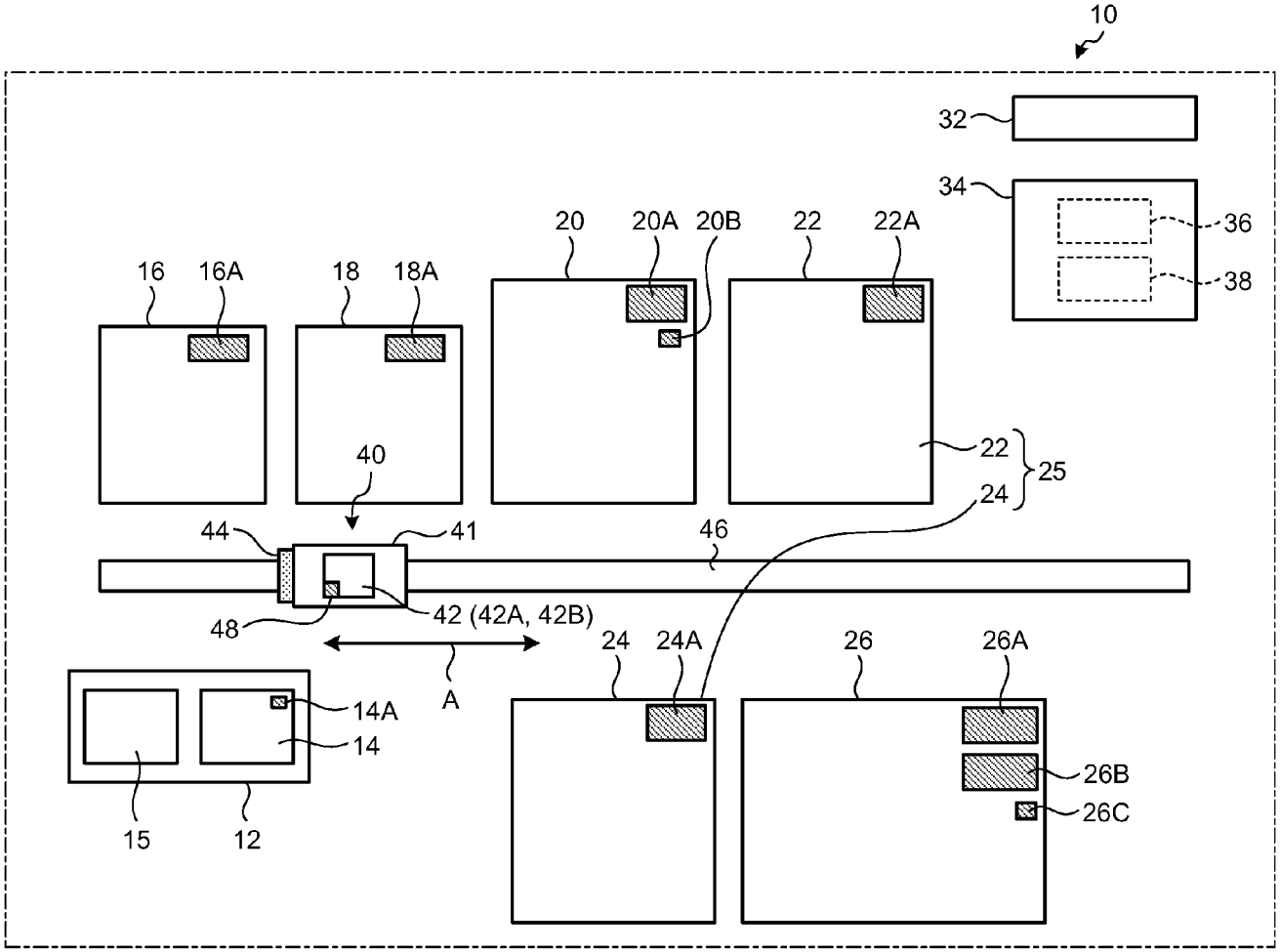
FIG. 1 is a plan view schematically illustrating a droplet-discharging-head manufacturing apparatus according to an embodiment.

FIG. 1 schematically illustrates a configuration of a droplet-discharging-head manufacturing apparatus (hereinafter, simply referred to as a "manufacturing apparatus") 10 according to an embodiment. The manufacturing apparatus 10 of the embodiment is an apparatus that manufactures a droplet discharging head, and in particular, forms a piezoelectric body of a piezoelectric element provided on the droplet discharging head.

Figure 2:
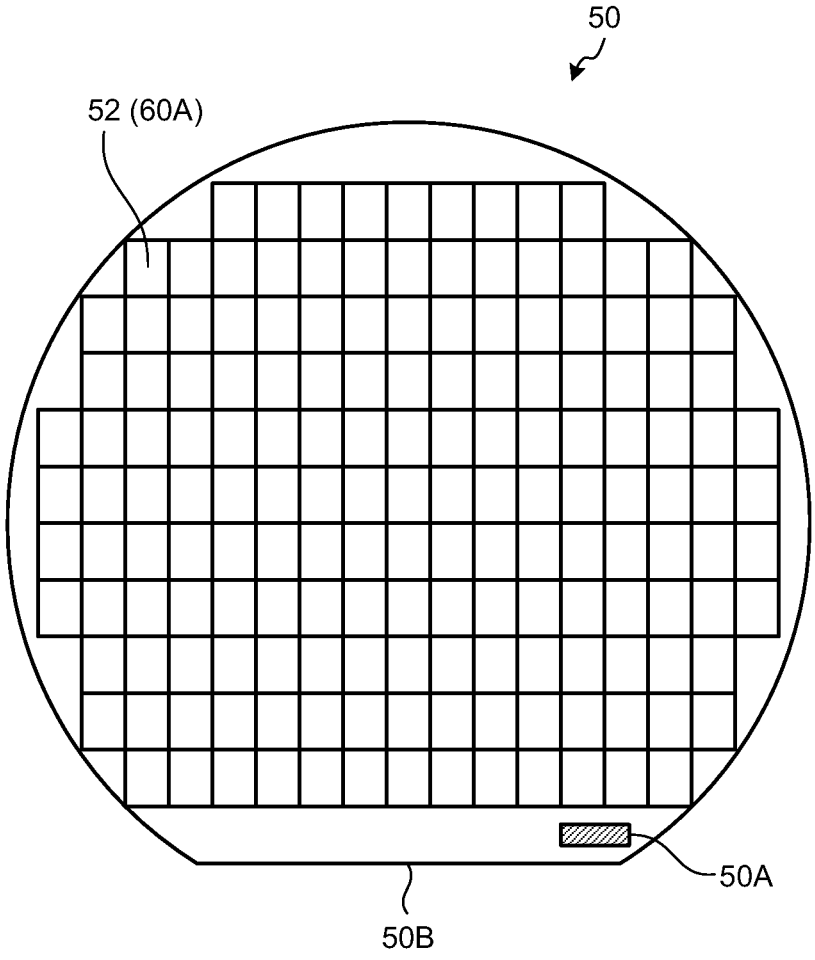
FIG. 2 is a plan view of an exemplary silicon wafer.

Specifically, the manufacturing apparatus 10 of the embodiment conveys silicon wafers 50 one by one, each of which is divided into a plurality of silicon chips 52 as illustrated in FIG. 2, and forms a laminated body of ferroelectric layers (details will be described below), which function as a piezoelectric body, on each of the silicon wafers 50.

An example for the configuration of a droplet discharging head 62 provided with a piezoelectric element will be explained below.

Figure 3:
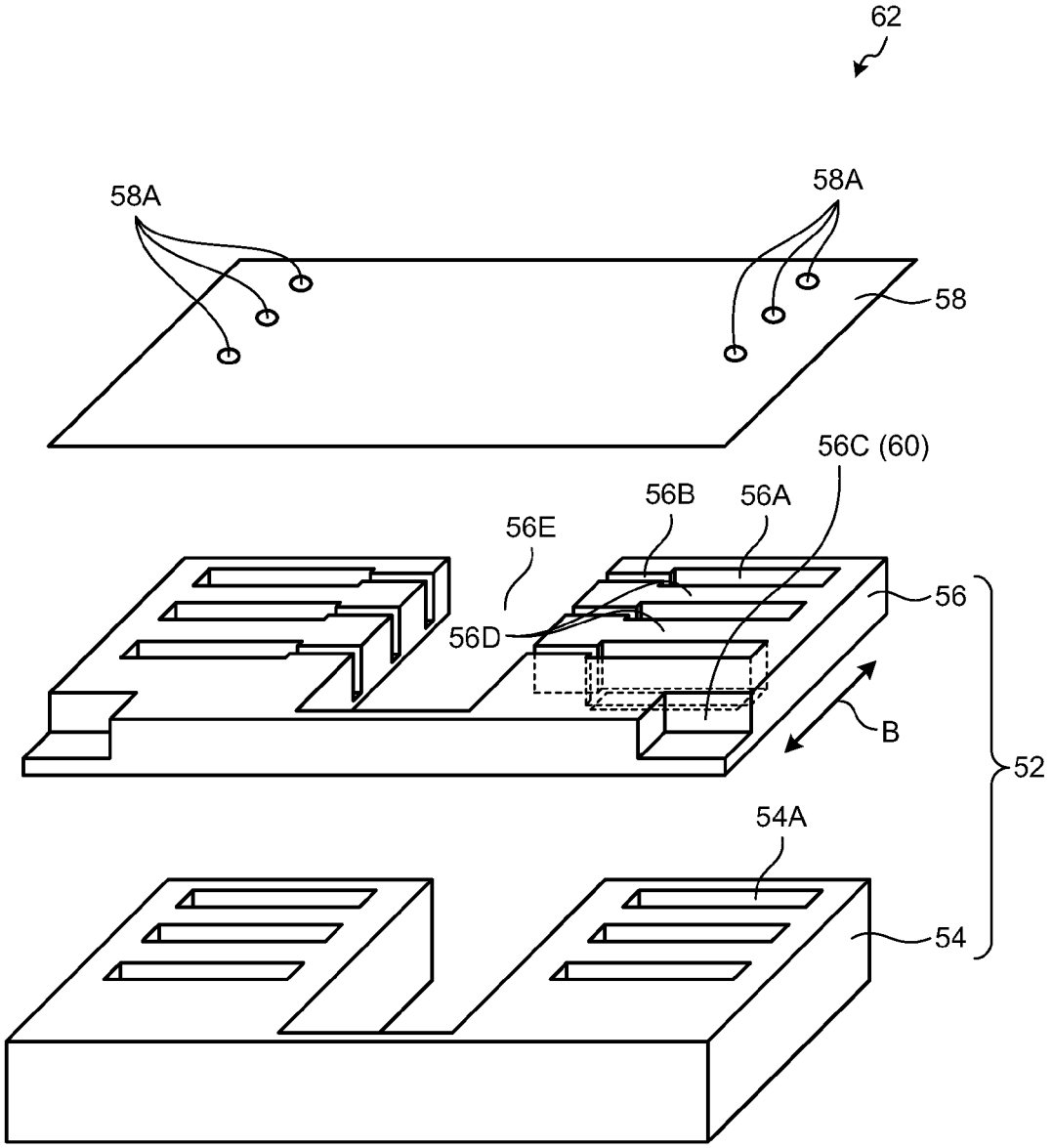
FIG. 3 is a schematic exploded perspective view of a droplet discharging head.
Figure 4:
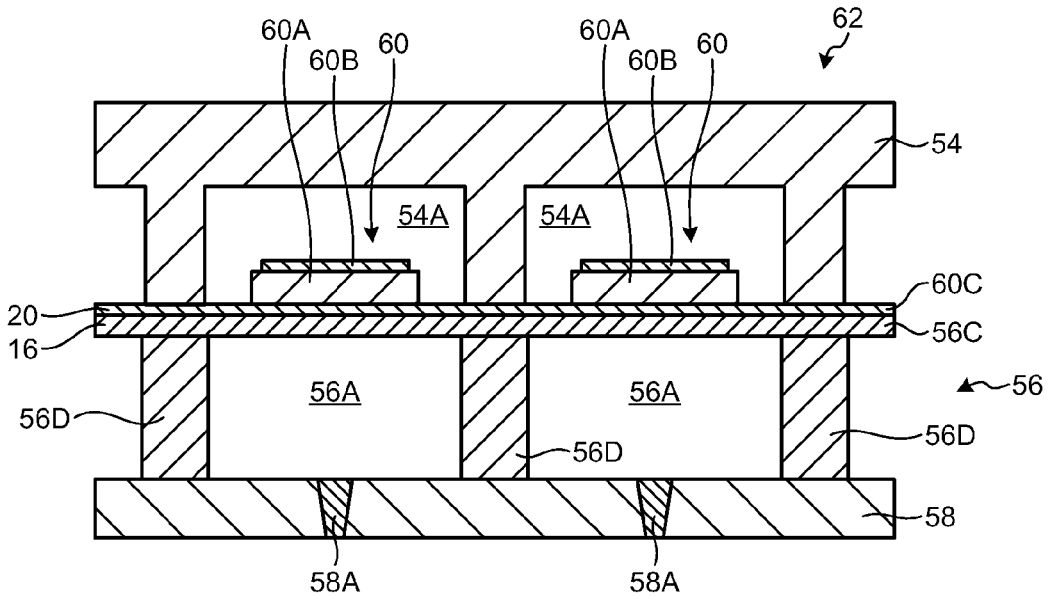
FIG. 4 is a schematic cross-sectional view of the droplet discharging head.

FIG. 3 is an exploded perspective view of the droplet discharging head 62. FIG. 4 is a cross-sectional view of the droplet discharging head 62. In the embodiment, a case is explained in which the droplet discharging head 62 is a laminated body of three substrates, i.e., a nozzle substrate 58, a liquid chamber substrate 56, and a protection substrate 54. A laminated body of the liquid chamber substrate 56 and the protection substrate 54 is the silicon chip 52 that is obtained by dividing the silicon wafer 50 as illustrated in FIG. 2.

In the embodiment, a case is explained in which the droplet discharging head 62 discharges ink droplets as droplets.

The nozzle substrate 58 includes a plurality of nozzle holes 58A for discharging ink droplets. The nozzle holes 58A are through holes piercing through the nozzle substrate 58 in a thickness direction of the nozzle substrate 58, and are aligned in a plurality of rows along a surface direction of the nozzle substrate 58.

The liquid chamber substrate 56 includes a plurality of pressurizing liquid chambers 56A communicating with the respective nozzle holes 58A; a shared liquid chamber 56E; and a plurality of fluid resistance portions 56B. The fluid resistance portions 56B enable communication between the pressurizing liquid chambers 56A and the shared liquid chamber 56E and function as fluid resistance units. When ink is supplied to the shared liquid chamber 56E, the ink supplied to the shared liquid chamber 56E is supplied to each of the pressurizing liquid chambers 56A via the corresponding fluid resistance portions 56B, so that the ink is ready to be discharged via the nozzle holes 58A.

The liquid chamber substrate 56 includes a diaphragm 56C and piezoelectric elements 60 that form the pressurizing liquid chambers 56A. Specifically, the diaphragm 56C and the piezoelectric elements 60 are directly formed on the liquid chamber substrate 56.

The piezoelectric elements 60 are disposed so as to correspond to the pressurizing liquid chambers 56A, respectively, via the diaphragm 56C. Each of the piezoelectric elements 60 is formed by laminating a lower electrode 60C, a piezoelectric body 60A, and an upper electrode 60B in this order. Each of the piezoelectric elements 60 is a lateral vibration type (a so-called bending mode type) that displaces the diaphragm 56C in a direction (the d31 direction) parallel to a surface of the diaphragm 56C opposing to the piezoelectric elements 60.

A constituent material of the piezoelectric body 60A may be any piezoelectric material as long as it can form a layer that exhibits a piezoelectric property. Examples of the piezoelectric material include a ferroelectric material, such as lead zirconate titanate (PZT) having a perovskite structure and containing Pb, Zr, and Ti as metal species; and a ferroelectric material added with a metal oxide such as niobium oxide, nickel oxide, or magnesium oxide.

Specifically, as the piezoelectric material, lead titanate ($PbTiO_3$), lead zirconate titanate ($Pb(Zr,Ti)O_3$), lead zirconium oxide ($PbZrO_3$), lead lanthanum titanate ($(Pb,La),TiO_3$), lead lanthanum zirconate titanate ($(Pb,La)(Zr,Ti)O_3$), or lead magnesium niobate-lead zirconate titanate ($Pb(Zr,Ti)O_3$—$Pb(Mg,Nb)O_3$) may be used.

The lower electrode 60C and the upper electrode 60B are layers having conductive properties and function as electrodes. The protection substrate 54 is a substrate for protecting each of the piezoelectric elements 60.

In the droplet discharging head 62 configured as above, liquid is supplied to each of the pressurizing liquid chambers 56A via the shared liquid chamber 56E and the fluid resistance portions 56B. When each of the chambers is filled with the liquid, a potential difference is applied between the lower electrode 60C and the upper electrode 60B. Therefore, the piezoelectric body 60A of each of the piezoelectric elements 60, to which a voltage due to the potential difference is applied, contracts along a surface direction of the diaphragm 56C. The deformation of the piezoelectric body 60A due to the application of the voltage to the lower electrode 60C and the upper electrode 60B may be described as a drive of the piezoelectric elements 60 in the following explanation.

Due to the deformation of the piezoelectric body 60A caused by the drive of the piezoelectric elements 60, a region corresponding to each of the piezoelectric elements 60 on the diaphragm 56C is deformed in a convex shape that protrudes toward the pressurizing liquid chambers 56A side. Due to the deformation of the diaphragm 56C, the inner volume of the pressurizing liquid chambers 56A is reduced and the pressure is increased, so that droplets are discharged from the nozzle holes 58A communicating with the pressurizing liquid chambers 56A.

The droplet discharging head 62 configured as above is manufactured through the following processes.

Figure 5:
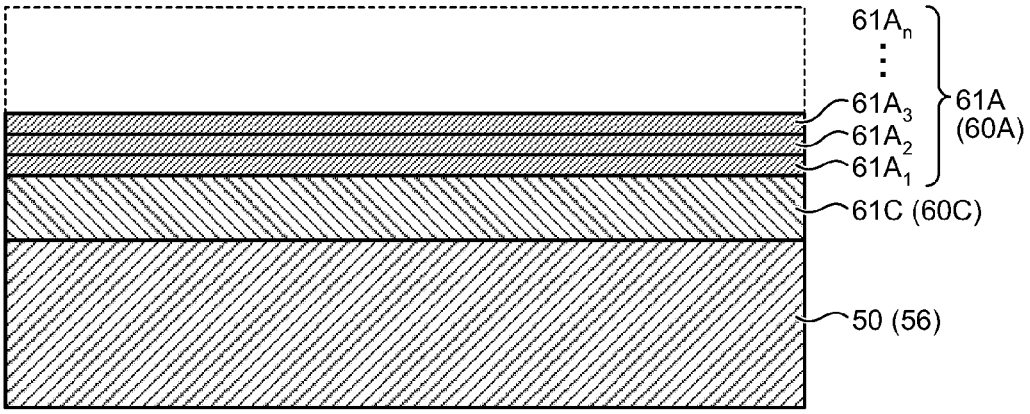
FIG. 5 is a schematic diagram illustrating a laminated state of a ferroelectric material formed by the droplet-discharging-head manufacturing apparatus.

As illustrated in FIG. 5, a lower conductive layer 61C that serves as the lower electrode 60C of the piezoelectric elements 60 is formed on the silicon wafer 50 that serves as the liquid chamber substrate 56. Thereafter, a plurality of ferroelectric layers 61A (ferroelectric layers 61$A_1$ to 61$A_n$) are laminated to form the piezoelectric body 60A with a desired thickness. Furthermore, an upper electrode layer (not illustrated) that serves as the upper electrode 60B (not illustrated in FIG. 5) is formed, and then the formed layers are subjected to patterning. As a result, the piezoelectric elements 60 as illustrated in FIG. 3 and FIG. 4 are formed on the silicon wafer 50. Thereafter, the protection substrate 54 as illustrated in FIG. 3 is mounted.

The silicon wafer 50 that is a laminated body of the protection substrate 54 and the liquid chamber substrate 56 with the piezoelectric elements 60 is cut into a plurality of the silicon chips 52 by a dicing saw or the like (see FIG. 2). Thereafter, the nozzle substrate 58 is bonded to each of the silicon chips 52; various members, such as a driving unit, is mounted on each of the silicon chips 52; or each of the silicon chips 52 is subjected to processing or the like. As a result, the droplet discharging heads 62 are manufactured.

The manufacturing apparatus 10 of the embodiment is an apparatus that includes various units for forming, in particular, the piezoelectric body 60A of the droplet discharging head 62 configured as above.

Referring back to FIG. 1, the manufacturing apparatus 10 is explained in detail below.

As illustrated in FIG. 1, the manufacturing apparatus 10 of the embodiment includes a supply-discharge stage 12, a housing member 14, a discharging member 15, a position adjusting unit 16, a cleaning unit 18, a film forming unit 20, a heating unit 25, a cooling unit 26, a conveying unit 40, an input unit 32, and a main control unit 34.

The housing member 14 houses the silicon wafers 50 provided with the lower conductive layers 61C that serve as the lower electrodes 60C (see FIGS. 6A to 6D).

The discharging member 15 is a member for housing the silicon wafers 50 after a plurality of the ferroelectric layers 61A are laminated on each of the silicon wafers 50 by the manufacturing apparatus 10. The supply-discharge stage 12 supports the housing member 14 and the discharging member 15.

The position adjusting unit 16 adjusts the center position and an orientation flat 50B (see FIG. 2) of the silicon wafer 50 to a predetermined position and in a predetermined direction, respectively. A predetermined region of the silicon wafer 50, the position of which has been adjusted, is held by the conveying unit 40, which will be described later, to convey the silicon wafer 50 to each of the cleaning unit 18, the film forming unit 20, a first heating unit 22, a second heating unit 24, and the cooling unit 26. Therefore, the silicon wafer 50, the position of which has been adjusted, is conveyed to each of the cleaning unit 18, the film forming unit 20, the first heating unit 22, the second heating unit 24, and the cooling unit 26.

The position adjusting unit 16 can adjust the position of one silicon wafer 50 at one time. The position adjusting unit 16 includes a position control unit 16A. The position control unit 16A is electrically connected to the main control unit 34. The position control unit 16A is electrically connected to a driving unit (not illustrated) that drives each unit of the position adjusting unit 16, and controls the driving unit to adjust the position of the silicon wafer 50.

The cleaning unit 18 cleans the silicon wafer 50. The cleaning unit 18 is a device that cleans one silicon wafer 50 at one time. The cleaning unit 18 cleans the silicon wafer 50 by using a known wet cleaning method or dry cleaning method. The cleaning unit 18 includes a cleaning control unit 18A that is electrically connected to the main control unit 34. The cleaning control unit 18A controls timing or duration of cleaning of the silicon wafer 50 in the cleaning unit 18

The film forming unit 20 forms a ferroelectric precursor film on the silicon wafer 50. The ferroelectric precursor film is a coating film made from a ferroelectric precursor solution (sol). The ferroelectric precursor solution (sol) is a solution obtained by dissolving the above-mentioned piezoelectric material as the constituent material of the piezoelectric body 60A in a solvent.

Examples of the ferroelectric precursor solution include a solution which is obtained by dissolving a lead zirconate titanate (PZT)-based material serving as a starting material in methoxyethanol as a common solvent. The starting material includes a piezoelectric material, such as lead acetate, zirconium isopropoxide, and titanium isopropoxide.

Examples of a method for forming the ferroelectric precursor film by the film forming unit 20 include, but not limited to, a spin coating method.

The film forming unit 20 includes a film formation control unit 20A for adjusting a film forming condition. The film formation control unit 20A is electrically connected to the main control unit 34 and the ferroelectric precursor film is formed on the silicon wafer 50 under the control of the main control unit 34. The film forming unit 20 can perform film formation on one of the silicon wafers 50 at one time.

A detecting unit 20B is included in the film forming unit 20. The detecting unit 20B detects whether or not the silicon wafer 50 is positioned in the film forming unit 20. The detecting unit 20B is electrically connected to the main control unit 34. Examples of the detecting unit 20B include a known infrared sensor.

While details will be described later, the silicon wafer 50 that has been cleaned by the cleaning unit 18 is conveyed to the film forming unit 20; therefore, it is possible to prevent extraneous matters, such as waste, from mixing into an interlayer position of the ferroelectric precursor film, enabling to prevent film defects. It may be possible to provide the cleaning unit 18 also in the film forming unit 20.

The heating unit 25 is a device that applies heat to the ferroelectric precursor film formed on the silicon wafer 50. The heating unit 25 includes the first heating unit 22 and the second heating unit 24.

The first heating unit 22 dries the ferroelectric precursor film formed by the film forming unit 20 by heating the ferroelectric precursor film to a first temperature. The first heating unit 22 includes a heat control unit 22A that is electrically connected to the main control unit 34. The main control unit 34 controls the heat control unit 22A to maintain the interior of the first heating unit 22 to a predetermined drying temperature. The configuration of the first heating unit 22 is not limited to a particular configuration; it is sufficient if the first heating unit 22 can apply heat to the ferroelectric precursor film of the silicon wafer 50 conveyed into the first heating unit 22. For example, the first heating unit 22 may be a contact-type device that directly brings a heating member, such as a hot plate, into contact with the silicon wafer 50.

The second heating unit 24 is a device that heats the ferroelectric precursor film at a second temperature that is higher than the temperature used in the first heating unit 22. Specifically, the second heating unit 24 performs a degreasing process for degreasing the ferroelectric precursor film by heating the ferroelectric precursor film to a predetermined temperature and maintaining the temperature for a predetermined duration, and performs a baking process for crystallizing the degreased ferroelectric precursor film. The degreasing is to remove, as $NO_2$, $CO_2$, or $H_2O$, organic constituents contained in the ferroelectric precursor film.

The second heating unit 24 includes a heat control unit 24A that adjusts a temperature condition inside the second heating unit 24. Specifically, the heat control unit 24A adjusts the temperature condition inside the second heating unit 24 to maintain the inner temperature of the second heating unit 24 at a temperature at which the degreasing process is possible or a temperature at which the baking process is possible, for a predetermined time. The second heating unit 24 is electrically connected to the main control unit 34 and controls the inner temperature of the second heating unit 24 under the control of the main control unit 34.

The configuration of the second heating unit 24 is not limited to a particular configuration; it is sufficient if the second heating unit 24 can apply heat at a temperature (the second temperature) at which the degreasing process or the baking process are possible to the ferroelectric precursor film of the silicon wafer 50 conveyed into the second heating unit 24. Examples of the second heating unit 24 include a hot plate and a rapid thermal processing (RTP) device that applies heat by illumination of an infrared lamp.

A detailed example for the configuration of the second heating unit 24 is illustrated in FIGS. 6A to 6D.

Figure 6A:
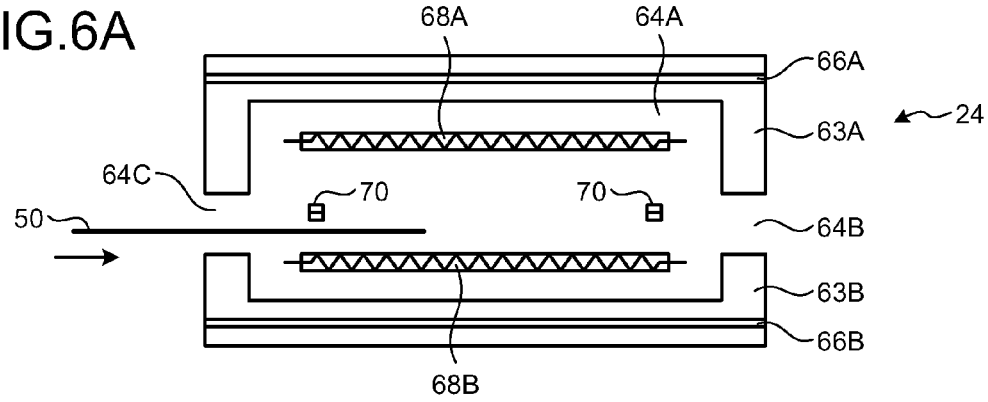
FIG. 6A is a schematic diagram illustrating an example configuration of a second heating unit when a silicon wafer is conveyed to the second heating unit.
Figure 6B:
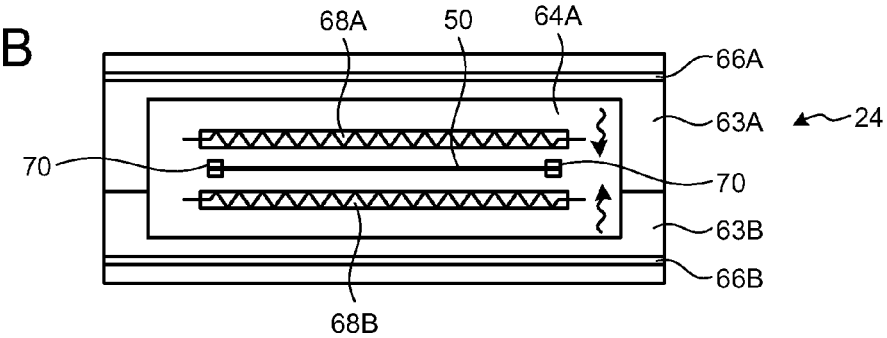
FIG. 6B is a schematic diagram illustrating an example configuration of the second heating unit when the silicon wafer is held and heated in the second heating unit.
Figure 6C:
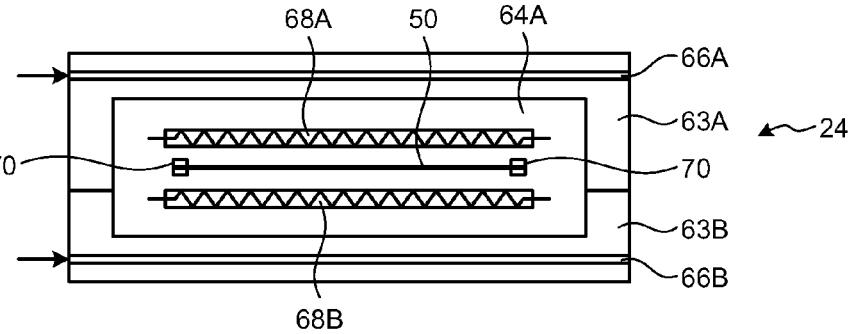
FIG. 6C is a schematic diagram illustrating an example configuration of the second heating unit when the silicon wafer held in the second heating unit is cooled.

The second heating unit 24 includes a frame 63A and a frame 63B as a pair. The frame 63A and the frame 63B have box shapes each having one open surface, and are arranged such that the open surfaces thereof are opposing each other. The frame 63A and the frame 63B are supported by a supporting member (not illustrated) so that the frames 63A and 63B can be driven to a state in which the frames 63A and 63B are separate from each other as illustrated in FIG. 6A (hereinafter, described as a separated state) or to a state in which the frames 63A and 63B are in contact with each other by covering the respective open surfaces each other as illustrated in FIG. 6B (hereinafter, described as a contact state). A driving unit (not illustrated) that drives the frames 63A and 63B is electrically connected to the heat control unit 24A, and the heat control unit 24A controls switching between the separated state and the contact state.

Figure 6D:
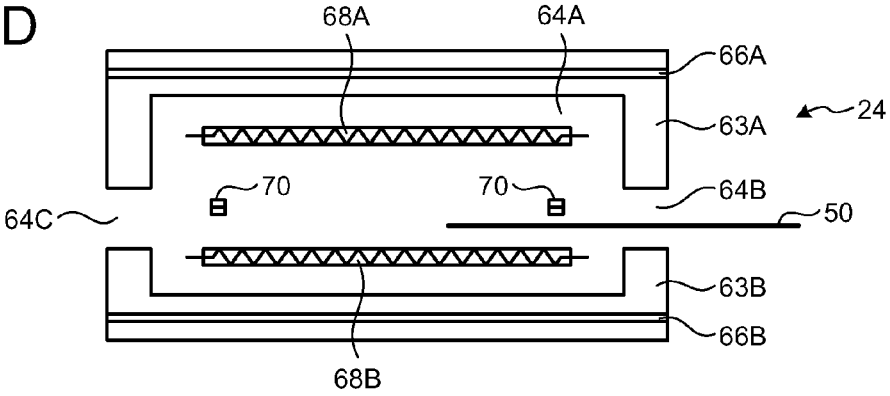
FIG. 6D is a schematic diagram illustrating an example configuration of the second heating unit when the silicon wafer is discharged from the second heating unit.

Gaps between the frames 63A and 63B when they are in the separated state are referred to as gaps 64B and 64C, as illustrated in FIGS. 6A and 6D.

Holders 70 supported by a supporting member (not illustrated) are arranged in a space 64A enclosed by the frames 63A and 63B. Inside the space 64A, the holders 70 support the silicon wafer 50 conveyed into the space 64A. The holders 70 are electrically connected to the heat control unit 24A, and are controlled by the main control unit 34 so as to be switched between a holding state in which the silicon wafer 50 is held and a releasing state in which holding of the silicon wafer 50 is released.

A heating unit 68A and a heating unit 68B are disposed in the space 64A enclosed by the frames 63A and 63B. The heating units 68A and 68B are not limited to particular configurations as long as the heating units 68A and 68B have heating mechanisms. For example, an infrared lamp may be used. The heating units 68A and 68B are electrically connected to the heat control unit 24A, and heating conditions are controlled under the control of the heat control unit 24A.

A cooling unit 66A is disposed in the frame 63A and a cooling unit 66B is disposed in the frame 63B. The cooling units 66A and 66B are electrically connected to the heat control unit 24A, and the interiors of the frame 63A and the frame 63B are cooled under the control of the heat control unit 24A.

Referring back to FIG. 1, the cooling unit 26 is a device that cools the silicon wafer 50 heated by the second heating unit 24. The cooling unit 26 includes a temperature control unit 26A. The temperature control unit 26A is electrically connected to the main control unit 34 and controls a temperature and humidity condition.

The cooling unit 26 is configured so as to hold a plurality of the silicon wafers 50 and cools the silicon wafers 50 being held to a room temperature.

Figure 7:
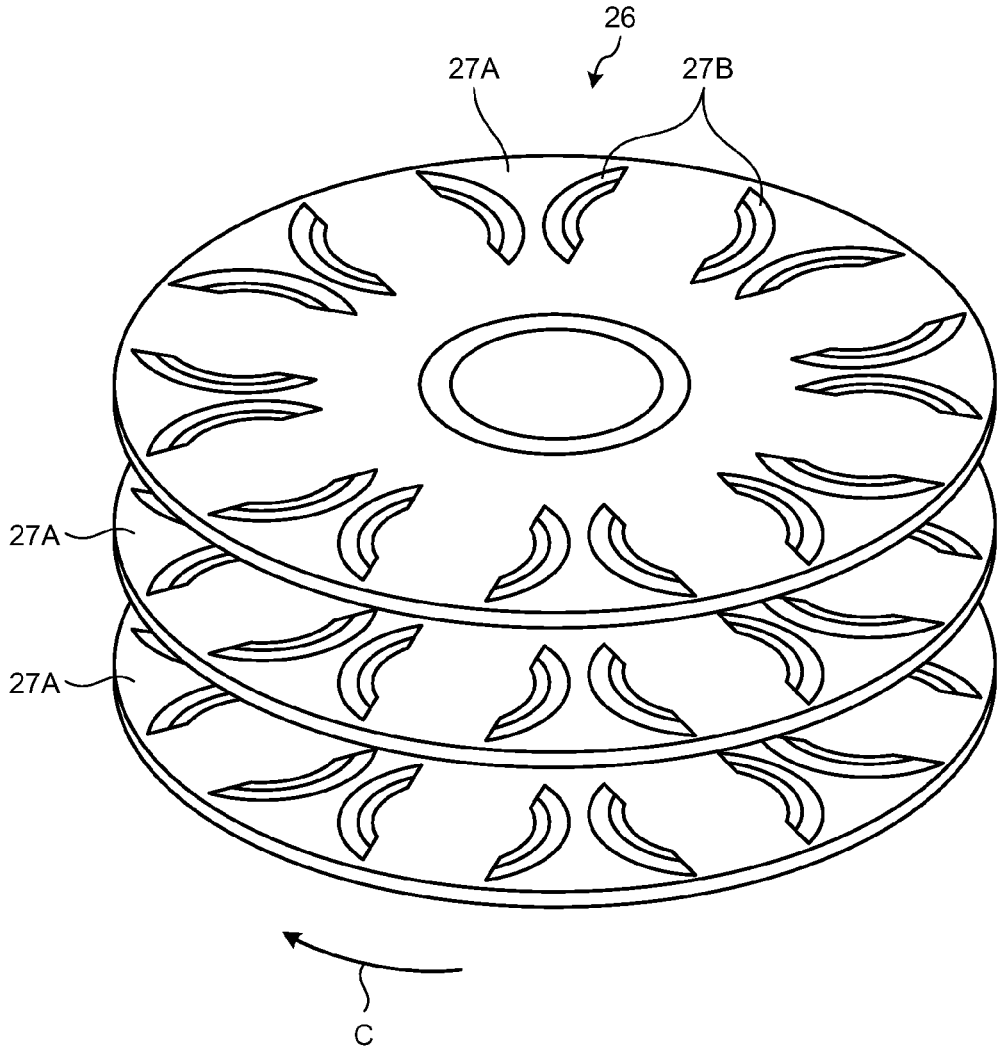
FIG. 7 is a perspective view of an example configuration of a cooling unit.

FIG. 7 illustrates an example configuration of the cooling unit 26 according to the embodiment.

As illustrated in FIG. 7, the cooling unit 26 includes a plurality of disk-shaped index tables 27A. The index tables 27A are arranged in rows at intervals such that the index tables 27A can rotate in a circumferential direction of the disk (a direction of arrow C in FIG. 7). The cooling unit 26 includes a rotation control unit 26B (see FIG. 1) and each of the index tables 27A can rotate in the circumferential direction by driving of the rotation control unit 26B. The rotation control unit 26B is electrically connected to the temperature control unit 26A (see FIG. 1).

Each of the index tables 27A includes stages 27B, each of which holds one silicon wafer 50.

The cooling unit 26 includes a detecting unit 26C. The detecting unit 26C detects presence or absence of the silicon wafer 50 on each of the index tables 27A. The detecting unit 26C is electrically connected to the main control unit 34 and transmits a detection result to the main control unit 34.

Referring back to FIG. 1, the conveying unit 40 includes a supporting unit 41, a rail 46, a conveying arm 42, a driving unit 44, and a reading unit 48.

The rail 46 is a long rail member extending in a direction along which the supply-discharge stage 12, the position adjusting unit 16, the cleaning unit 18, the film forming unit 20, the first heating unit 22, the second heating unit 24, and the cooling unit 26 are arranged. In the embodiment, as illustrated in FIG. 1, a total of two rows are arranged such that the position adjusting unit 16, the cleaning unit 18, the film forming unit 20, and the first heating unit 22 are arranged in one row while the supply-discharge stage 12, the second heating unit 24, and the cooling unit 26 are arranged in the other row. The rail 46 has a long shape extending along the arrangement direction of the above units and is arranged between the two rows in which the units are arranged. Therefore, in the embodiment, the conveying unit 40 can convey the silicon wafer 50 among the supply-discharge stage 12, the position adjusting unit 16, the cleaning unit 18, the film forming unit 20, the first heating unit 22, the second heating unit 24, and the cooling unit 26 in a short time.

The driving unit 44 is electrically connected to the main control unit 34. Examples of the driving unit 44 include a motor. The supporting unit 41 is a member for supporting the conveying arm 42. The supporting unit 41 is supported by a linear guide (not illustrated) that is supported so as to move in the longitudinal direction of the rail 46.

The conveying arm 42 includes an arm unit 42A and a holding unit 42B. The holding unit 42B is a member that maintains a holding state in which the silicon wafers 50 are held one by one or a releasing state in which the holding of the silicon wafers 50 is released. The arm unit 42A is an arm-shaped member that extends and retracts by being bent by a bending unit (not illustrated) toward each of the position adjusting unit 16, the cleaning unit 18, the film forming unit 20, the first heating unit 22, the second heating unit 24, the cooling unit 26, and the discharging member 15. The arm unit 42A and the holding unit 42B are electrically connected to the driving unit 44.

Therefore, the supporting unit 41 is driven by the driving unit 44 under the control of the main control unit 34 to move along the longitudinal direction of the rail 46. Furthermore, by being driven by the driving unit 44 under the control of the main control unit 34, the arm unit 42A and the holding unit 42B move so as to take one silicon wafer 50 from the housing member 14 and convey the silicon wafer 50 to the position adjusting unit 16. Similarly, by the movement of the supporting unit 41 and the driving of the arm unit 42A and the holding unit 42B, the silicon wafers 50 are conveyed one by one through the position adjusting unit 16, the cleaning unit 18, the film forming unit 20, the first heating unit 22, the second heating unit 24, the cooling unit 26, the supply-discharge stage 12, and the discharging member 15.

In the embodiment, an explanation is given of a case that the conveying unit 40 includes the rail 46 so that the supporting unit 41 and the conveying arm 42 can move along the rail 46; however, it may be possible to configure the conveying unit 40 without disposing the rail 46. In this case, it may be possible to fix the supporting unit 41 and cause the conveying arm 42 to reach each of the units (the supply-discharge stage 12, the position adjusting unit 16, the cleaning unit 18, the film forming unit 20, the first heating unit 22, the second heating unit 24, and the cooling unit 26).

The conveying unit 40 includes the reading unit 48. The reading unit 48 reads a management ID (a management number) arranged on the silicon wafer 50. A known scanner or the like may be used as the reading unit 48. As illustrated in FIG. 2, the management ID for uniquely identifying each of the silicon wafers 50 is marked in a predetermined region 50A of each of the silicon wafers 50. The reading unit 48 is a device that reads the management ID marked in the region 50A on the silicon wafer 50. The reading unit 48 is electrically connected to the main control unit 34 and transmits the read management ID to the main control unit 34.

In the embodiment, the reading unit 48 is arranged on the conveying unit 40 as described above; therefore, the reading unit 48 is capable of reading the management ID of the silicon wafer 50 that is to be conveyed or being conveyed by the conveying unit 40.

Referring back to FIG. 1, the input unit 32 inputs and outputs various information. The input unit 32 is electrically connected to the main control unit 34. Examples of the input unit 32 include a keyboard and a display with a touch panel. In the embodiment, for example, a user operates the input unit 32 to input, from the input unit 32, various processing conditions, such as a heating temperature or a cooling temperature, used in the position adjusting unit 16, the cleaning unit 18, the film forming unit 20, the first heating unit 22, the heating unit 25, or the cooling unit 26.

The main control unit 34 includes a control unit 36 and a storage unit 38. The control unit 36 includes a central processing unit (CPU), a read only memory (ROM) that stores therein a program for executing a manufacturing process to be described later, a random access memory (RAM) for storing data or the like, and a bus that connects the above components to one another. The control unit 36 is electrically connected to each of the units provided in the manufacturing apparatus 10. Specifically, the control unit 36 is electrically connected to the driving unit 44, the reading unit 48, the position control unit 16A, the cleaning control unit 18A, the film formation control unit 20A, the detecting unit 20B, the heat control unit 22A, the heat control unit 24A, the temperature control unit 26A, the rotation control unit 26B, the detecting unit 26C, the input unit 32, the storage unit 38, and the like.

The storage unit 38 is a recording medium, such as a hard disk drive (HDD).

Figure 8:
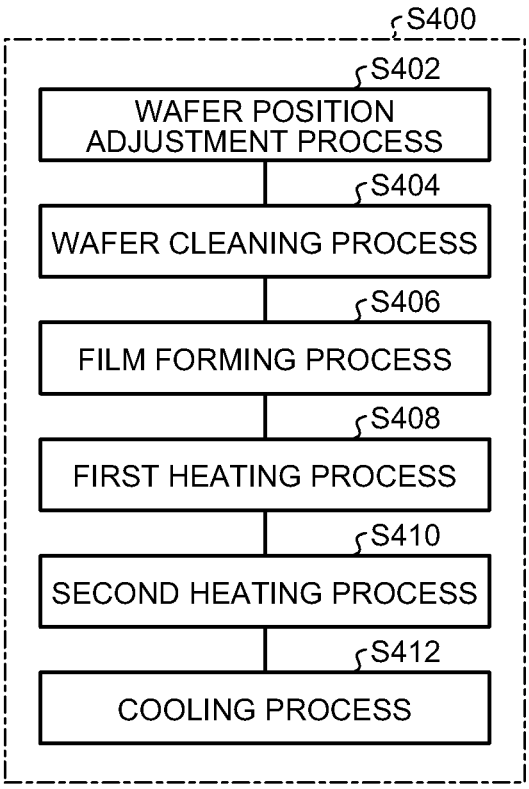
FIG. 8 is a diagram illustrating a flow of processes performed by the droplet-discharging-head manufacturing apparatus.
Figure 9A:
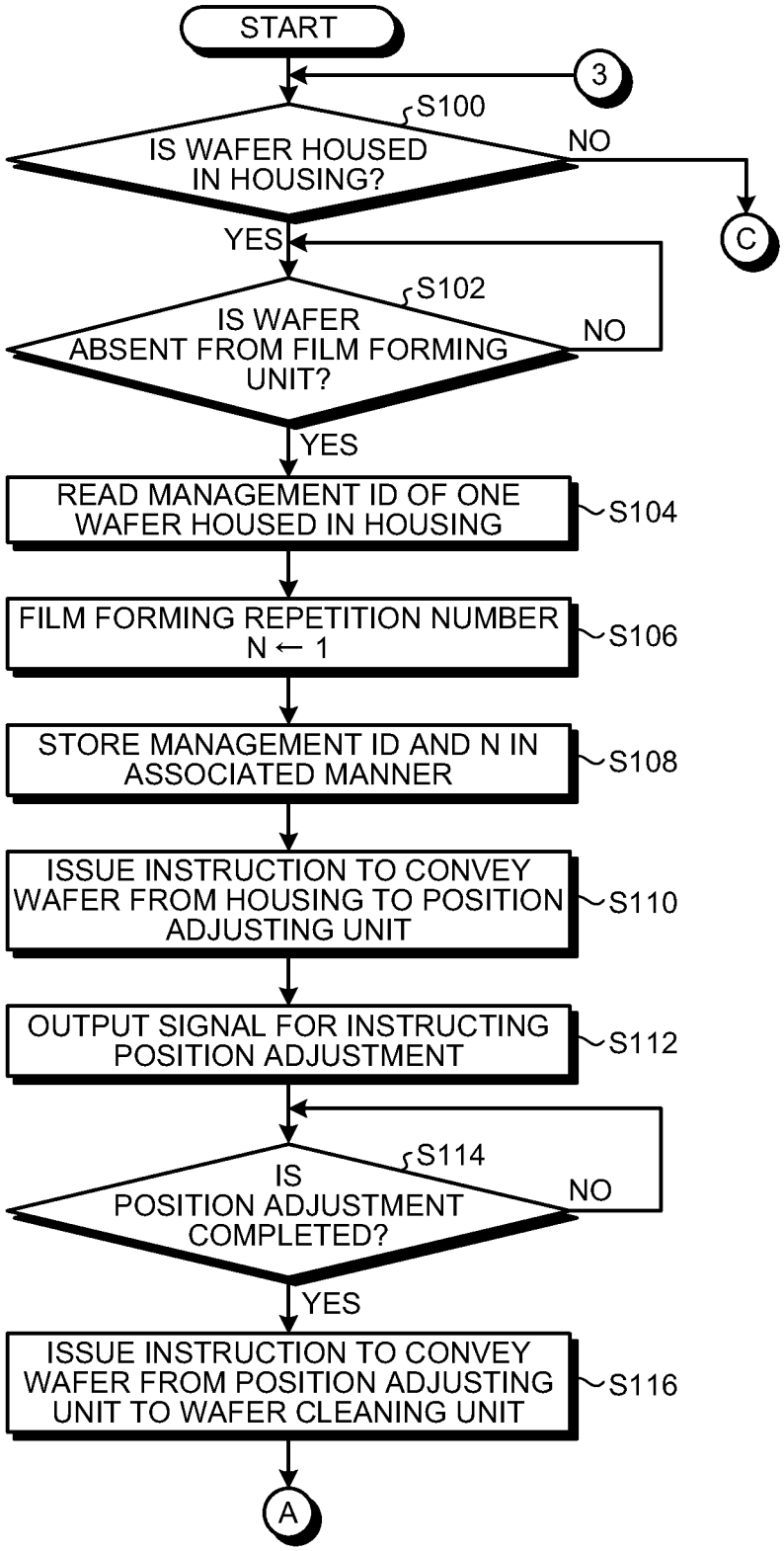
FIGS. 9A to 9D are flowcharts of a manufacturing process performed by a control unit of the droplet-discharging-head manufacturing apparatus according to the embodiment.
Figure 9B:
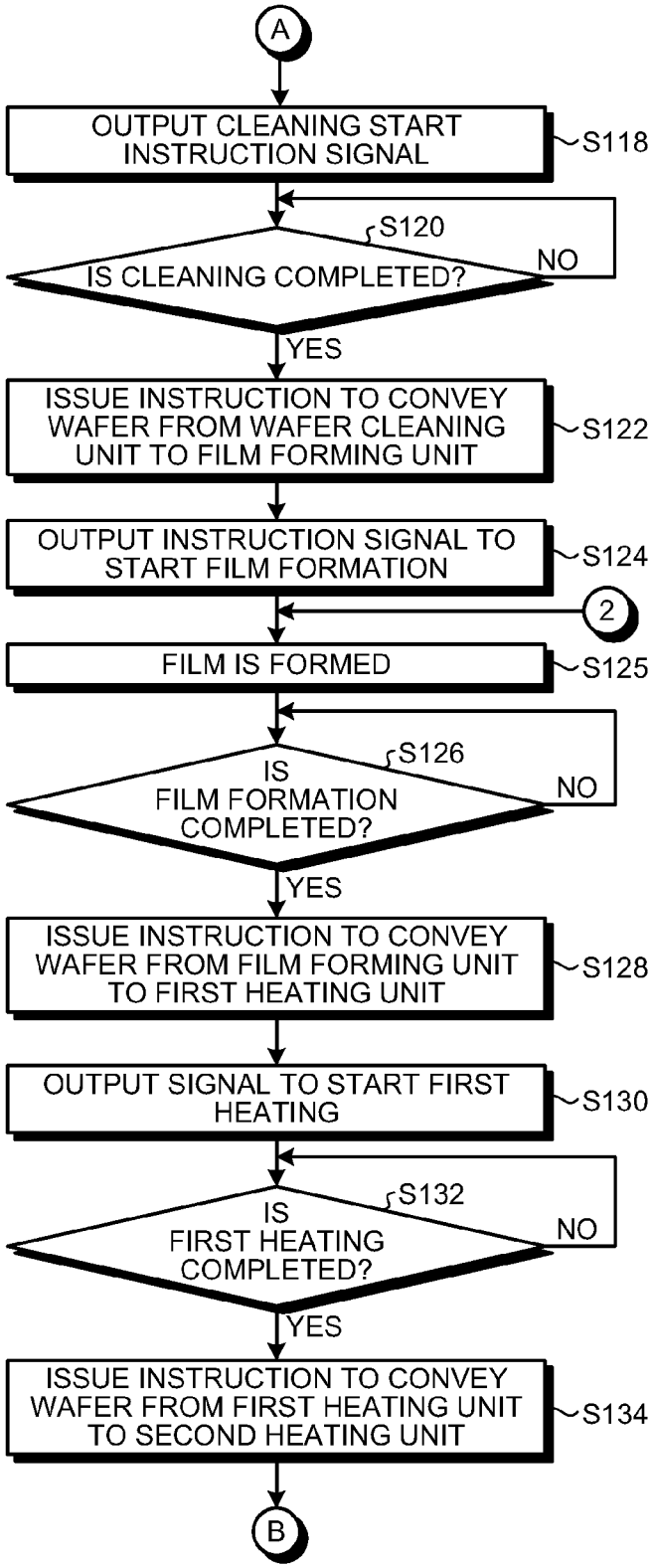
Figure 9C:
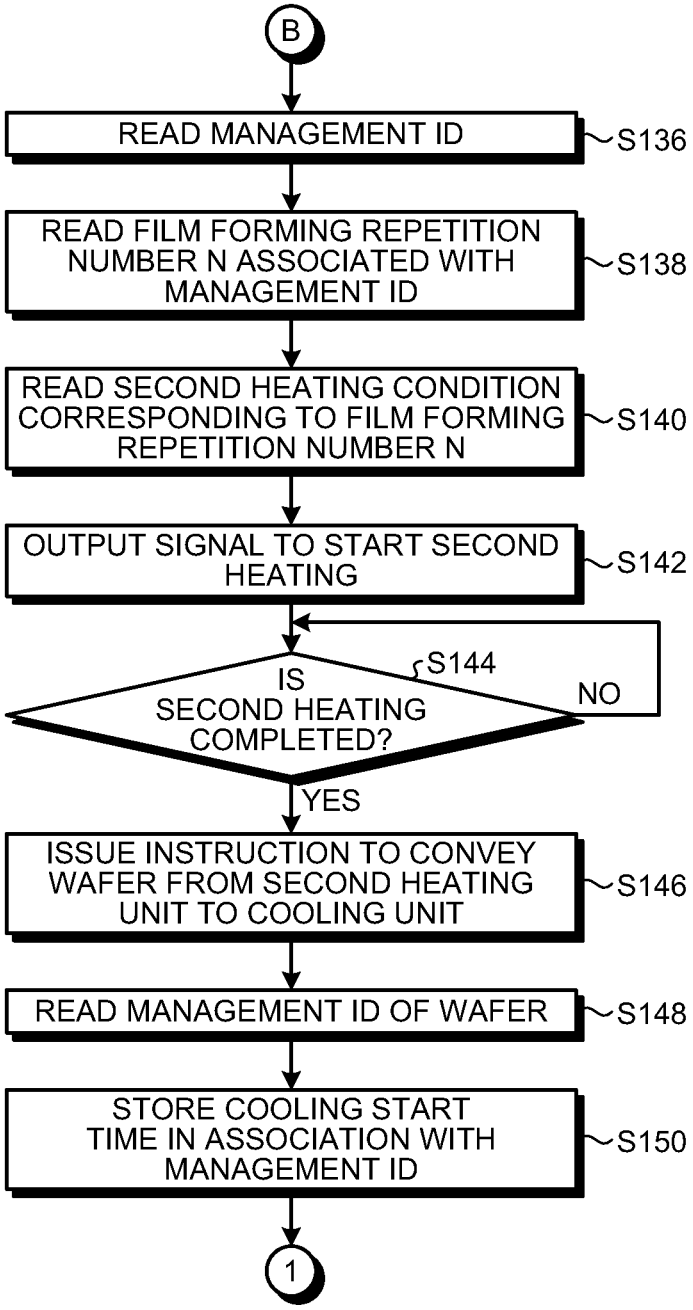
Figure 9D:
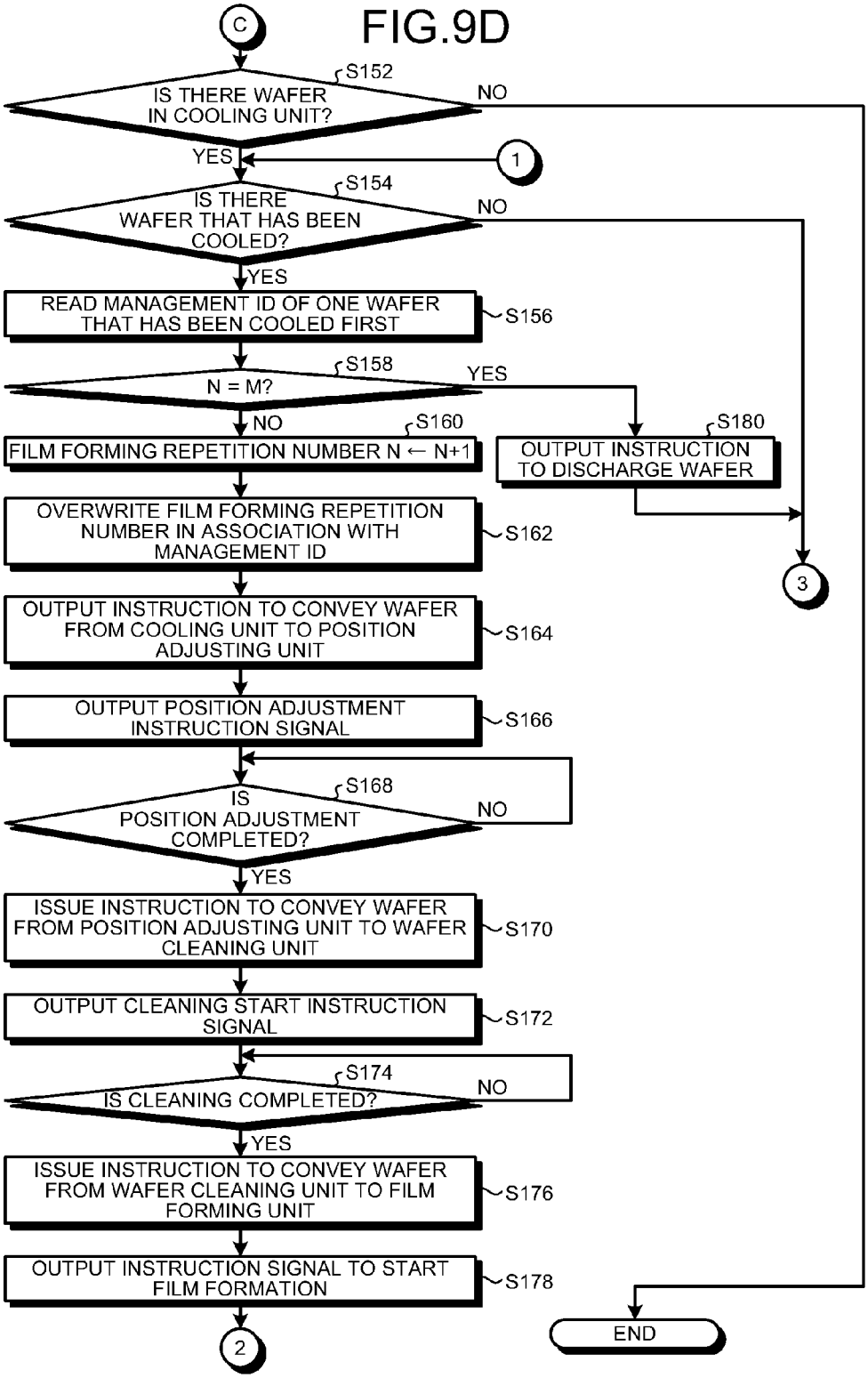

An overview of a process for forming the ferroelectric layer 61A of the droplet-discharging-head 62 by the manufacturing apparatus 10 of the embodiment will be explained below with reference to FIG. 8.

The ferroelectric layer 61A is formed through the following processes (S400) in the manufacturing apparatus 10.

The conveying unit 40 takes one silicon wafer 50 out of the housing member 14 that houses a plurality of the silicon wafers 50, and conveys the silicon wafer 50 to the position adjusting unit 16. The position adjusting unit 16 adjusts the center position and the orientation flat 50B of the silicon wafer 50 (a wafer position adjustment process: Step S402).

The conveying unit 40 conveys the silicon wafer 50, which has been subjected to the position adjustment, to the cleaning unit 18. The cleaning unit 18 cleans the silicon wafer 50 (a wafer cleaning process: Step S404).

The conveying unit 40 conveys the one silicon wafer 50, which has been subjected to the position adjustment and cleaning, to the film forming unit 20. The film forming unit 20 forms a ferroelectric precursor film on the silicon wafer 50 (a film forming process: Step S406).

The conveying unit 40 conveys the silicon wafer 50, on which the ferroelectric precursor film has been formed, to the first heating unit 22. The first heating unit 22 dries the ferroelectric precursor film (a first heating process: Step S408).

The conveying unit 40 conveys the silicon wafer 50 from the first heating unit 22 to the second heating unit 24. The second heating unit 24 heats the ferroelectric precursor film, which has been dried by the first heating unit 22, to perform degreasing or both of degreasing and baking (a second heating process: Step S410).

The conveying unit 40 conveys the silicon wafer 50, which has been subjected to the second heating process, to the cooling unit 26. The cooling unit 26 cools the silicon wafer 50 to the room temperature (a cooling process: Step S412).

Through a series of the above processes, i.e., the wafer position adjustment process, the wafer cleaning process, the film forming process, the first heating process, the second heating process, and the cooling process (Step S402 to Step S412), one ferroelectric layer 61A is formed on the silicon wafer 50.

The thickness of the ferroelectric layer 61A formed by the series of the processes is much thinner than a desired thickness of the piezoelectric body 60A. Therefore, in the manufacturing apparatus 10, the wafer position adjustment process, the wafer cleaning process, the film forming process, the first heating process, the second heating process, and the cooling process (Step S402 to Step S412) are repeated in this order. As a result, the ferroelectric layers $61A_1$ to $61A_n$ (n is an integer equal to or greater than 2) are laminated to form the ferroelectric layer 61A with a desired thickness (see FIG. 5).

The baking process in the second heating process may be performed every time the series of the processes is performed or may be performed once after a ferroelectric layer $61A_M$ on the M-th layer being the topmost layer is formed through repetition of the series of the processes.

The manufacturing process performed by the manufacturing apparatus 10 according to the embodiment will be explained in detail below.

FIGS. 9A to 9D are flowcharts of an overall flow of a process for manufacturing the ferroelectric layer 61A of the droplet discharging head 62 by the manufacturing apparatus 10 according to the embodiment.

The control unit 36 reads, from the ROM (not illustrated), a computer program of a manufacturing process for the droplet discharging head 62 and executes a routine of the manufacturing process illustrated in FIGS. 9A to 9D at regular time intervals.

In the explanation, it is assumed that a certain number of the silicon wafers 50 that can be processed within a predetermined time, for example, a certain number of the silicon wafers 50 that can be processed by the manufacturing apparatus 10 within 24 hours, are housed in the housing member 14 before execution of the routine of the manufacturing process illustrated in FIGS. 9A to 9D.

Each of the silicon wafers 50 housed in the housing member 14 is the silicon wafer 50 on which the lower conductive layer 61C that serves as the lower electrode 60C has already been formed as described above.

The control unit 36 determines whether the silicon wafer 50 is housed in the housing member 14 (Step S100). The control unit 36 determines presence or absence of the silicon wafer 50 in the housing member 14 by reading a detection signal from a detecting unit 14A.

When determining that the silicon wafer 50 is housed in the housing member 14 (YES at Step S100), the control unit 36 determines whether or not the silicon wafer 50 is absent from the film forming unit 20 (Step S102). The control unit 36 determines presence or absence of the silicon wafer 50 in the film forming unit 20 by reading a detection signal from the detecting unit 20B.

The control unit 36 repeats negative determination until determining that the silicon wafer 50 is absent from the film forming unit 20 (NO at Step S102). When determining that the silicon wafer 50 is absent from the film forming unit 20 (YES at Step S102), the control unit 36 reads the management ID of one silicon wafer 50 among the silicon wafers 50 housed in the housing member 14 (Step S104). The control unit 36 reads the management ID of the silicon wafer 50 by reading a signal showing the management ID read by the reading unit 48.

The control unit 36 sets "1" indicating the first film formation, as a film forming repetition number N indicating the number of times the film formation has been repeated on the ferroelectric layer 61A corresponding to the read management ID (Step S106).

The control unit 36 stores the management ID read at Step S104 and "1" as the information on the film forming repetition number N set at Step S106 in the storage unit 38 in an associated manner (Step S108).

The control unit 36 outputs, to the conveying unit 40, a conveyance instruction signal indicating conveyance of the silicon wafer 50, the management ID of which has been read at Step S104, from the housing member 14 to the position adjusting unit 16 (Step S110).

The driving unit 44 of the conveying unit 40 receives the conveyance instruction signal. When receiving the conveyance instruction signal, the driving unit 44 moves the supporting unit 41 to a position at which the conveying arm 42 can convey the silicon wafer 50 between the housing member 14 and the position adjusting unit 16, along the longitudinal direction of the rail 46. The driving unit 44 extends the arm unit 42A toward the housing member 14, causes the holding unit 42B to hold the silicon wafer 50 from which the management ID has been read at Step S104, causes the arm unit 42A to retract, extend, or turn to convey the silicon wafer 50 to the position adjusting unit 16, and causes the holding unit 42B to release the holding of the silicon wafer 50.

The holding unit 42B holds the silicon wafer 50, from which the management ID has been read at Step S104, in the following manner, for example. Specifically, assuming that the reading unit 48 is arranged on a tip portion of the holding unit 42B, the reading unit 48 performs reading when the holding unit 42B moves to a position at which the holding unit 42B can hold the silicon wafer 50. In the process at Step S104, the management ID is read after the driving unit 44 moves the arm unit 42A and the holding unit 42B to a position at which one silicon wafer 50 can be held, and after the management ID is read, the holding unit 42B holds the silicon wafer 50. When receiving, from the control unit 36, a conveyance instruction to convey the silicon wafer 50 to the position adjusting unit 16, the driving unit 44 conveys the silicon wafer 50 being held from the housing member 14 to the position adjusting unit 16.

Through the processes performed by the control unit 36 at Step S100 to Step S110 as described above, one silicon wafer 50 is conveyed from the housing member 14 to the position adjusting unit 16. In addition, the management ID and the information on the film forming repetition number N of the conveyed silicon wafer 50 are stored in the storage unit 38 in an associated manner.

The control unit 36 outputs, to the position control unit 16A, a position adjustment instruction signal for issuing an instruction to perform position adjustment (Step S112). When receiving the position adjustment instruction signal, the position control unit 16A controls each unit arranged on the position adjusting unit 16 to adjust the center position of the silicon wafer 50 and the position of the orientation flat 50B to predetermined positions. When completing the position adjustment, the position control unit 16A outputs a signal indicating completion of the position adjustment to the control unit 36.

The control unit 36 repeats negative determination until receiving the signal indicating the completion of the position adjustment from the position control unit 16A (NO at Step S114). When determining that the signal indicating the completion of the position adjustment is received (YES at Step S114), the control unit 36 outputs, to the driving unit 44 of the conveying unit 40, a signal for issuing an instruction to convey the silicon wafer 50 from the position adjusting unit 16 to the cleaning unit 18 (Step S116).

When receiving the signal for issuing the instruction to convey the silicon wafer 50 from the position adjusting unit 16 to the cleaning unit 18, the driving unit 44 moves, along the longitudinal direction of the rail 46, the supporting unit 41 to a position at which the conveying arm 42 can convey the silicon wafer 50 between the position adjusting unit 16 and the cleaning unit 18. The driving unit 44 extends the arm unit 42A toward the position adjusting unit 16, causes the holding unit 42B to hold the silicon wafer 50, causes the arm unit 42A to retract or extend to convey the silicon wafer 50 to the cleaning unit 18, and causes the holding unit 42B to release the holding of the silicon wafer 50.

Through the process at Step S116, the one silicon wafer 50, the position of which has been adjusted by the position adjusting unit 16, is conveyed from the position adjusting unit 16 to the cleaning unit 18.

The control unit 36 outputs, to the cleaning control unit 18A, a cleaning start instruction signal for issuing an instruction to start cleaning (Step S118). When receiving the cleaning start instruction signal, the cleaning control unit 18A starts cleaning of the silicon wafer 50 placed in the cleaning unit 18, and when completing the cleaning, outputs a signal indicating the completion of the cleaning to the control unit 36.

The control unit 36 repeats negative determination until receiving the signal indicating the completion of the cleaning from the cleaning unit 18 (NO at Step S120). When determining that the signal indicating the completion of the cleaning is received (YES at Step S120), the control unit 36 outputs, to the driving unit 44 of the conveying unit 40, a signal for issuing an instruction to convey the silicon wafer 50 from the cleaning unit 18 to the film forming unit 20 (Step S122).

When receiving the signal for issuing the instruction to convey the silicon wafer 50 from the cleaning unit 18 to the film forming unit 20, the driving unit 44 moves, along the longitudinal direction of the rail 46, the supporting unit 41 to a position at which the conveying arm 42 can convey the silicon wafer 50 between the cleaning unit 18 and the film forming unit 20. The driving unit 44 extends the arm unit 42A toward the cleaning unit 18, causes the holding unit 42B to hold the silicon wafer 50, causes the arm unit 42A to retract, extend, or turn to convey the silicon wafer 50 to the film forming unit 20, and causes the holding unit 42B to release the holding of the silicon wafer 50.

Thus, the one silicon wafer 50 is conveyed to the cleaning unit 18 to the film forming unit 20.

The control unit 36 outputs, to the film formation control unit 20A, an instruction signal to start film formation indicating a start of film formation (Step S124). When receiving the instruction signal to start film formation, the film formation control unit 20A applies a coating film made by coating a piezoelectric precursor solution on the silicon wafer 50 conveyed to the film forming unit 20, thereby forming one piezoelectric precursor layer (Step S125). When completing the film forming process, the film formation control unit 20A outputs a signal indicating the completion of the film formation to the control unit 36.

The control unit 36 repeats negative determination until receiving the signal indicating the completion of the film formation (NO at Step S126). When receiving the signal indicating the completion of the film formation, the control unit 36 determines affirmatively that the film formation is completed (YES at Step S126).

When determining that the signal indicating the completion of the film formation is received (YES at Step S126), the control unit 36 outputs, to the driving unit 44 of the conveying unit 40, a signal instructing conveyance of the silicon wafer 50 from the film forming unit 20 to the first heating unit 22 (Step S128).

When receiving the signal for issuing an instruction to convey the silicon wafer 50 from the film forming unit 20 to the first heating unit 22, the driving unit 44 moves, along the longitudinal direction of the rail 46, the supporting unit 41 to a position at which the conveying arm 42 can convey the silicon wafer 50 between the film forming unit 20 and the first heating unit 22. The driving unit 44 extends the arm unit 42A toward the film forming unit 20, causes the holding unit 42B to hold the silicon wafer 50, causes the arm unit 42A to retract, extend, or turn to convey the silicon wafer 50 to the first heating unit 22, and causes the holding unit 42B to release the holding of the silicon wafer 50.

Thus, the one silicon wafer 50 is conveyed from the film forming unit 20 to the first heating unit 22.

The control unit 36 outputs, to the heat control unit 22A, a signal indicating a start of first heating (drying) (Step S130). When receiving the signal indicating a start of the first heating, the heat control unit 22A heats the interior of the first heating unit 22 to a temperature at which the ferroelectric layer 61A is dried, and performs a drying process. In the embodiment, a case is explained that the interior of the first heating unit 22 is heated after the silicon wafer 50 is conveyed into the first heating unit 22; however, the first heating unit 22 may be maintained at the temperature for the first heating in advance.

After pre-set drying time needed for the drying has elapsed since the start of the drying or the conveyance of the silicon wafer 50 into the first heating unit 22, the heat control unit 22A outputs a signal indicating completion of the first heating to the control unit 36.

When determining that the signal indicating the completion of the first heating is received (YES at Step S132), the control unit 36 outputs, to the driving unit 44 of the conveying unit 40, a signal for issuing an instruction to convey the silicon wafer 50 from the first heating unit 22 to the second heating unit 24 (Step S134).

When receiving the signal for issuing the instruction to convey the silicon wafer 50 from the first heating unit 22 to the second heating unit 24, the driving unit 44 moves, along the longitudinal direction of the rail 46, the supporting unit 41 to a position at which the conveying arm 42 can convey the silicon wafer 50 between the first heating unit 22 and the second heating unit 24. The driving unit 44 extends the arm unit 42A toward the first heating unit 22, causes the holding unit 42B to hold the silicon wafer 50, and causes the arm unit 42A to retract or extend to convey the silicon wafer 50 to the second heating unit 24.

The control unit 36 reads, from the reading unit 48, the management ID of the silicon wafer 50 being held by the holding unit 42B of the conveying unit 40 (Step S136). The control unit 36 outputs, to the conveying unit 40, a signal for releasing the holding of the silicon wafer 50 and thereafter reads, from the storage unit 38, information indicating the film forming repetition number N associated with the read management ID (Step S138). The control unit 36 also reads, from the storage unit 38, a second heating condition corresponding to the read film forming repetition number N (Step S140).

For example, assuming that the film forming repetition number for forming the topmost ferroelectric layer 61A is M, the storage unit 38 stores therein M indicating the film forming repetition number of the topmost layer in advance. The storage unit 38 also stores therein a heating condition indicating a degreasing process in association with each of the film forming repetition numbers 1 to M−1 as the heating condition for each of ferroelectric layers $\mathbf{61}A_1$ to $\mathbf{61}A_{M-1}$ other than the topmost ferroelectric layer $\mathbf{61}A_M$. The storage unit 38 also stores therein two types of heating conditions indicating that a baking process is to be performed after the degreasing process, in association with M indicating the film forming repetition number of the topmost ferroelectric layer $\mathbf{61}A_{M-1}$.

The control unit 36 outputs, to the heat control unit 24A, a second heating start signal indicating to start second heating under the second heating condition read at Step S140 (Step S142).

When receiving the second heating start signal, the heat control unit 24A heats the silicon wafer 50 under the heating condition contained in the received second heating signal. When completing the second heating process, the heat control unit 24A outputs a signal indicating the completion of the second heating to the control unit 36.

Specifically, when the second heating unit 24 is configured as illustrated in FIGS. 6A to 6D, the second heating unit 24 performs the following processes.

When the conveying unit 40 to be described later conveys one silicon wafer 50 to the second heating unit 24, the frame 63A and the frame 63B are separated from each other under the control of the heat control unit 24A (see FIG. 6A). When the silicon wafer 50 is positioned in the space 64A, the silicon wafer 50 is held by the holders 70 and the frame 63A and the frame 63B are brought into contact with each other under the control of the heat control unit 24A (see FIG. 6B).

The heating units 68A and 68B are heated to a temperature corresponding to the heating condition contained in the second heating start signal under the control of the heat control unit 24A. At this time, heating may be performed by using one of the heating units 68A and 68B or by using both of the heating units 68A and 68B. When the second heating start signal contains the heating condition indicating that the baking is to be performed after the degreasing, the heating units 68A and 68B are maintained at the temperature for the degreasing process and then continuously heated until reaching a baking temperature.

The heat control unit 24A causes the cooling units 66A and 66B to be supplied with cooling media after a predetermined degreasing time or a predetermined total time of the degreasing time and the baking time has elapsed. Thus, the frames 63A and 63B are cooled, so that the silicon wafer 50 in the space 64A is cooled. After a time needed to reduce the temperature to a predetermined temperature has elapsed since the controlled supply of the cooling media, the heat control unit 24A separates the frames 63A and 63B from each other. Subsequently, the heat control unit 24A outputs a signal indicating completion of the second heating to the control unit 36 and brings the holders 70 to the releasing state.

Through the processes at Step S136 to Step S142, the control unit 36 can perform the second heating under the heating condition corresponding to the film forming repetition number of each of the silicon wafers 50.

The control unit 36 repeats negative determination until receiving the signal indicating the completion of the second heating from the heat control unit 24A (NO at Step S144). When receiving the signal indicating the completion of the second heating, the control unit 36 determines affirmatively that the second heating is completed (YES at Step S144).

When determining that the signal indicating the completion of the second heating is received (YES at Step S144), the control unit 36 outputs, to the driving unit 44 of the conveying unit 40, a signal for issuing an instruction to convey the silicon wafer 50 from the second heating unit 24 to the cooling unit 26 (Step S146).

When receiving the signal for issuing the instruction to convey the silicon wafer 50 from the second heating unit 24 to the cooling unit 26, the driving unit 44 moves, along the longitudinal direction of the rail 46, the supporting unit 41 to a position at which the conveying arm 42 can convey the silicon wafer 50 between the second heating unit 24 and the cooling unit 26. The driving unit 44 extends the arm unit 42A toward the second heating unit 24, causes the holding unit 42B to hold the silicon wafer 50, and causes the arm unit 42A to retract or extend to convey the silicon wafer 50 to the cooling unit 26.

Thus, the one silicon wafer 50 is conveyed from the second heating unit 24 to the cooling unit 26.

The control unit 36 reads, from the reading unit 48, the management ID of the silicon wafer 50 being held by the holding unit 42B of the conveying unit 40 (Step S148). The control unit 36 outputs, to the conveying unit 40, a signal for releasing the holding of the silicon wafer 50 (not illustrated). The control unit 36 reads a current time from an internal timer and stores the read time, as a cooling start time, in the storage unit 38 in association with the management ID read at Step S148 (Step S150). When receiving the signal for releasing the holding of the silicon wafer 50, the conveying unit 40 places the silicon wafer 50 that has been being held to the stage 27B.

The control unit 36 determines whether or not the silicon wafer 50 that has been cooled is present in the cooling unit 26

(Step S154). The control unit 36 determines whether there is a management ID for which an elapsed time from the cooling start time stored in the storage unit 38 is equal to or longer than a predetermined cooling time, to thereby determine whether or not the silicon wafer 50 that has been cooled is present. The predetermined cooling time indicates a time that has elapsed since when the cooling is started on the silicon wafer 50 that has been heated by the second heating unit 24 and conveyed to the cooling unit 26 until when the silicon wafer 50 reaches the room temperature. The predetermined cooling time is measured and stored in the storage unit 38 in advance.

When the control unit 36 determines that the silicon wafer 50 that has been cooled is not present in the cooling unit 26 (NO at Step S154), the process returns to Step S100.

On the other hand, when determining that the silicon wafer 50 that has been cooled is present in the cooling unit 26 (YES at Step S154), the control unit 36 reads, from the storage unit 38, the management ID of the silicon wafer 50 that has been cooled first (Step S156). Specifically, the control unit 36 reads the management ID associated with the earliest cooling start time from among the management IDs for each of which the elapsed time since the cooling start time stored in the storage unit 38 is equal to or longer than the predetermined cooling time.

The control unit 36 determines whether or not the film forming repetition number N corresponding to the management ID read at Step S156 is M that indicates the topmost layer (Step S158). When determining that the film forming repetition number N is M indicating the topmost layer (YES at Step S158), because film formation of all of the ferroelectric layers 61A to be formed is completed, the control unit 36 outputs, to the driving unit 44 of the conveying unit 40, an instruction to discharge the silicon wafer 50 corresponding to the management ID (Step S180).

When receiving the instruction to discharge the silicon wafer 50, the driving unit 44 moves, along the longitudinal direction of the rail 46, the supporting unit 41 to a position at which the conveying arm 42 reaches the cooling unit 26. The driving unit 44 extends the arm unit 42A to the cooling unit 26 and moves the arm unit 42A until the reading unit 48 reads a management ID corresponding to the management ID contained in the received discharge instruction signal. When the reading unit 48 reads the management ID, the driving unit 44 drives the holding unit 42B to hold the silicon wafer 50 corresponding to the management ID and conveys the silicon wafer 50 from the cooling unit 26 to the discharging member 15.

Therefore, the silicon wafer 50, on which the desired number (M) of the ferroelectric layers 61A are laminated, is discharged to the discharging member 15.

The control unit 36 outputs the instruction signal to start film formation to the driving unit 44 similarly to the process at Step S124 (Step S178), and the process returns to Step S126.

On the other hand, when negative determination is made at Step S158 (NO at Step S158), the control unit 36 increments the film forming repetition number N corresponding to the management ID read at Step S156 by one, and overwrites the film forming repetition number N in the storage unit 38 with the incremented film forming repetition number N in association with the management ID (Step S160 and Step S162).

The control unit 36 outputs, to the driving unit 44, a conveyance instruction signal indicating that the silicon wafer 50 corresponding to the management ID read at Step S156 is conveyed from the cooling unit 26 to the position adjusting unit 16 (Step S164).

When receiving the signal indicating conveyance of the silicon wafer 50 from the cooling unit 26 to the second heating unit 24, the driving unit 44 moves, along the longitudinal direction of the rail 46, the supporting unit 41 to a position at which the conveying arm 42 reaches the cooling unit 26. The driving unit 44 extends the arm unit 42A to the cooling unit 26 and moves the arm unit 42A until the reading unit 48 reads a management ID corresponding to the management ID contained in the received discharge instruction signal. When the reading unit 48 reads the management ID, the driving unit 44 drives the holding unit 42B to hold the silicon wafer 50 corresponding to the management ID and conveys the silicon wafer 50 from the cooling unit 26 to the position adjusting unit 16.

The control unit 36 outputs, to the position control unit 16A, a position adjustment instruction signal for issuing an instruction to perform position adjustment (Step S166). When receiving the position adjustment instruction signal, the position control unit 16A controls each unit provided on the position adjusting unit 16 to adjust the center position of the silicon wafer 50 and the position of the orientation flat 50B to predetermined positions. When completing the position adjustment, the position control unit 16A outputs a signal indicating the completion of the position adjustment to the control unit 36.

The control unit 36 repeats negative determination until receiving the signal indicating the completion of the position adjustment from the position control unit 16A (NO at Step S168). When determining that the signal indicating the completion of the position adjustment is received (YES at Step S168), the control unit 36 outputs, to the driving unit 44 of the conveying unit 40, a signal for issuing an instruction to convey the silicon wafer 50 from the position adjusting unit 16 to the cleaning unit 18 (Step S170).

When receiving the signal for issuing the instruction to convey the silicon wafer 50 from the position adjusting unit 16 to the cleaning unit 18, the driving unit 44 moves, along the longitudinal direction of the rail 46, the supporting unit 41 to a position at which the conveying arm 42 can convey the silicon wafer 50 between the position adjusting unit 16 and the cleaning unit 18. The driving unit 44 extends the arm unit 42A toward the position adjusting unit 16, causes the holding unit 42B to hold the silicon wafer 50, causes the arm unit 42A to retract or extend to convey the silicon wafer 50 to the cleaning unit 18, and causes the holding unit 42B to release the holding of the silicon wafer 50.

Through the process at Step S170, the one silicon wafer 50, the position of which has been adjusted by the position adjusting unit 16, is conveyed from the position adjusting unit 16 to the cleaning unit 18.

The control unit 36 outputs, to the cleaning control unit 18A, a cleaning start instruction signal for issuing an instruction to start cleaning (Step S172). When receiving the cleaning start instruction signal, the cleaning control unit 18A starts cleaning of the silicon wafer 50 placed in the cleaning unit 18, and when completing the cleaning, outputs a signal indicating the completion of the cleaning to the control unit 36.

The control unit 36 repeats negative determination until receiving the signal indicating completion of the cleaning from the cleaning unit 18 (NO at Step S174). When determining that the signal indicating the completion of the cleaning is received (YES at Step S174), the control unit 36 outputs, to the driving unit 44 of the conveying unit 40, a signal for issuing an instruction to convey the silicon wafer 50 from the cleaning unit 18 to the film forming unit 20 (Step S176).

When receiving the signal for issuing the instruction to convey the silicon wafer 50 from the cleaning unit 18 to the film forming unit 20, the driving unit 44 moves, along the longitudinal direction of the rail 46 the supporting unit 41 to a position at which the conveying arm 42 can convey the silicon wafer 50 between the cleaning unit 18 and the film forming unit 20. The driving unit 44 extends the arm unit 42A toward the cleaning unit 18, causes the holding unit 42B to hold the silicon wafer 50, causes the arm unit 42A to retract or extend to convey the silicon wafer 50 to the film forming unit 20, and causes the holding unit 42B to release the holding of the silicon wafer 50.

The control unit 36 outputs, to the film formation control unit 20A, an instruction signal to start film formation indicating a start of film formation (Step S178). When receiving the instruction signal to start film formation, the film formation control unit 20A applies a coating film made from a piezoelectric precursor solution on the silicon wafer 50 conveyed to the film forming unit 20, thereby forming one piezoelectric precursor layer. When completing the film forming process, the film formation control unit 20A outputs a signal indicating the completion of the film formation to the control unit 36.

After the process at Step S178 is completed, the control unit 36 returns the process to Step S126.

On the other hand, at Step S152, when it is determined that the silicon wafer 50 is not present in the cooling unit 26 (NO at Step S152), because the process is completed on all of the silicon wafers 50, the routine is terminated.

Figure 10:
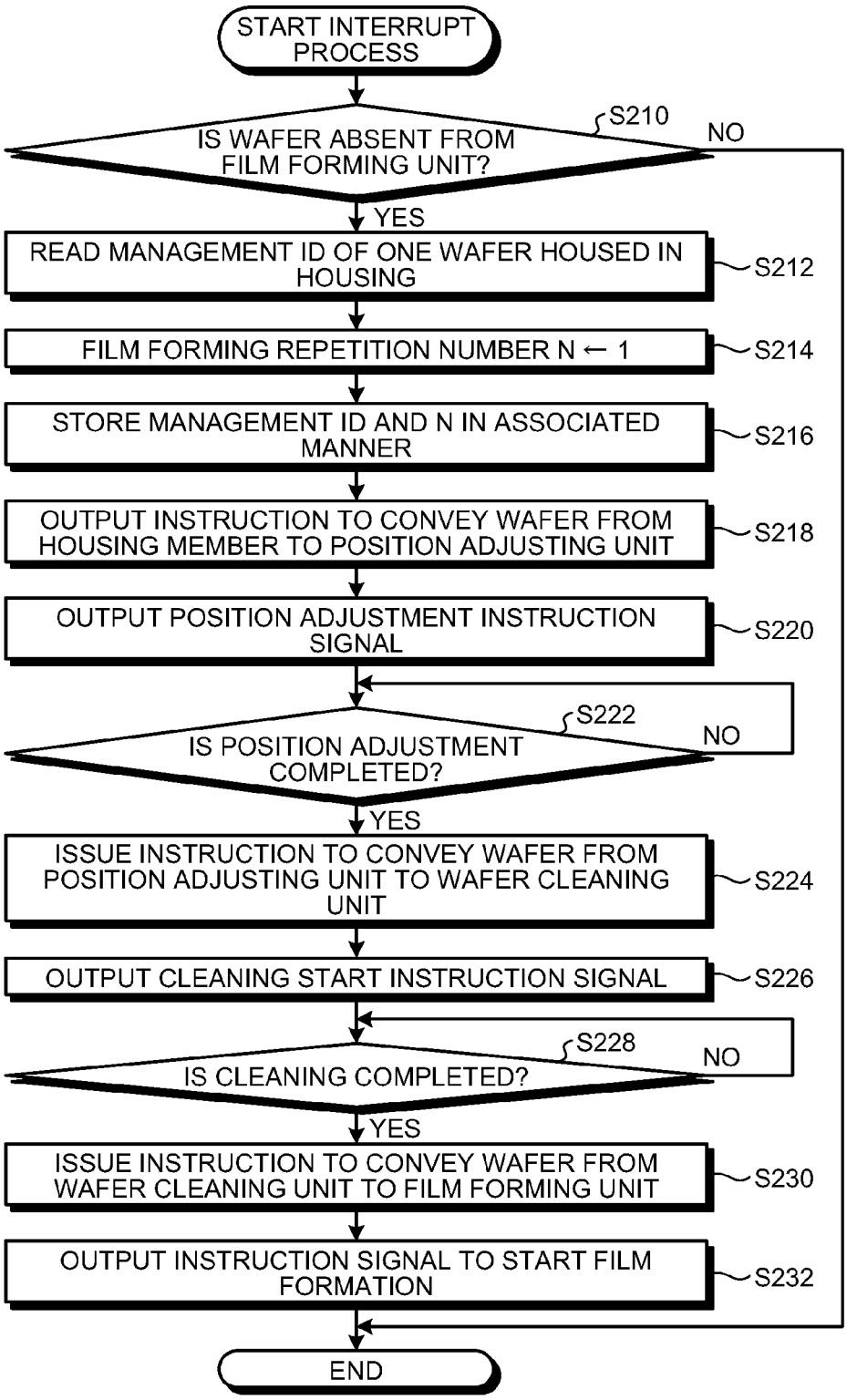
FIG. 10 is a flowchart of an interrupt process, which is performed in the manufacturing process illustrated in FIGS. 9A to 9D by the control unit of the droplet-discharging-head manufacturing apparatus of the embodiment.

The control unit 36 executes an interrupt process similar to the process from Step S102 to Step S124 at regular intervals in the routine of the manufacturing process illustrated in FIGS. 9A to 9D (see FIG. 10).

Specifically, the control unit 36 performs the interrupt process illustrated in FIG. 10 at regular time intervals.

The control unit 36 determines whether or not the silicon wafer 50 is absent from the film forming unit 20 (Step S210). When determining that the silicon wafer 50 is present in the film forming unit 20 (NO at Step S210), the control unit 36 terminates the routine.

On the other hand, when determining that the silicon wafer 50 is absent from the film forming unit 20 (YES at Step S210), the control unit 36 reads the management ID of one silicon wafer 50 from among the silicon wafers 50 housed in the housing member 14.

The control unit 36 sets "1" indicating the first film formation, as the film forming repetition number N indicating the number of film formation of the ferroelectric layer 61A corresponding to the read management ID (Step S214).

The control unit 36 stores the management ID read at Step S212 and "1" as the information indicating the film forming repetition number N set at Step S214 in the storage unit 38 in an associated manner (Step S216).

The control unit 36 outputs, to the conveying unit 40, a conveyance instruction signal indicating conveyance of the silicon wafer 50, the management ID of which has been read at Step S212, from the housing member 14 to the position adjusting unit 16 (Step S218).

The control unit 36 outputs, to the position control unit 16A, a position adjustment instruction signal for issuing an instruction to perform position adjustment (Step S220). The control unit 36 repeats negative determination until receiving a signal indicating completion of the position adjustment (NO at Step S222). When determining that the signal indicating the completion of the position adjustment is received (YES at Step S222), the control unit 36 outputs, to the driving unit 44 of the conveying unit 40, a signal for issuing an instruction to convey the silicon wafer 50 from the position adjusting unit 16 to the cleaning unit 18 (Step S224).

The control unit 36 outputs, to the cleaning control unit 18A, a cleaning start instruction signal for issuing an instruction to start cleaning (Step S226). The control unit 36 repeats negative determination until receiving a signal indicating the completion of the cleaning from the cleaning unit 18 (NO at Step S228). When determining that the signal indicating the completion of the cleaning is received (YES at Step S228), the control unit 36 outputs, to the driving unit 44 of the conveying unit 40, a signal for issuing an instruction to convey the silicon wafer 50 from the cleaning unit 18 to the film forming unit 20 (Step S230).

The control unit 36 outputs, to the film formation control unit 20A, an instruction signal to start film formation indicating a start of film formation (Step S232), and thereafter terminates the routine.

Through the interrupt process at Step S210 to Step S232, when the silicon wafer 50 is not present in the film forming unit 20, the silicon wafers 50 are sequentially conveyed from the housing member 14 to the film forming unit 20 via the position adjusting unit 16 and the cleaning unit 18.

As described above, the manufacturing apparatus 10 of the embodiment conveys the silicon wafers 50 one by one and repeats the position adjustment process by the position adjusting unit 16, the cleaning process by the cleaning unit 18, the film forming process by the film forming unit 20, the first heating process by the first heating unit 22, the second heating process by the second heating unit 24, and the cooling process by the cooling unit 26 in this order on each of the silicon wafers 50.

Therefore, it is possible to prevent a variation in the thermal history between the ferroelectric layers 61A formed on each of the silicon wafers 50. It is also possible to prevent a variation in the thermal history of the ferroelectric layer 61A between the silicon wafers 50.

As a result, it is possible to prevent a variation in the discharging property between the droplet discharging heads 62.

The manufacturing apparatus 10 of the embodiment can adjust the heating condition for the second heating process according to the film forming repetition number. Therefore, it is possible to perform the second heating under the heating condition according to the film forming repetition number corresponding to the management ID of the silicon wafer 50.

In the embodiment described above, the heating conditions are separately set for the topmost ferroelectric layer $\mathbf{61}A_M$ and for the ferroelectric layers $\mathbf{61}A_1$ to $\mathbf{61}A_{M-1}$ other than the topmost layer; however, the way to setting the heating conditions is not limited to this. For example, it may be possible to store a heating condition for the second heating process, which indicates that the baking process is performed after the degreasing process at every predetermined film forming repetition numbers, in the storage unit 38 in association with the film forming repetition numbers.

For example, a multiple of three (e.g., 3N) is set as the predetermined film forming repetition number, and a heating condition of performing the baking process after the degreasing process is stored in the storage unit 38 as the heating condition for the second heating process, in association with the film forming repetition number 3N. In addition, a heating condition for performing the degreasing process is stored in the storage unit 38 as the heating condition for the second heating process in the case that the film forming repetition number is other than the multiple of three.

Figure 11A:
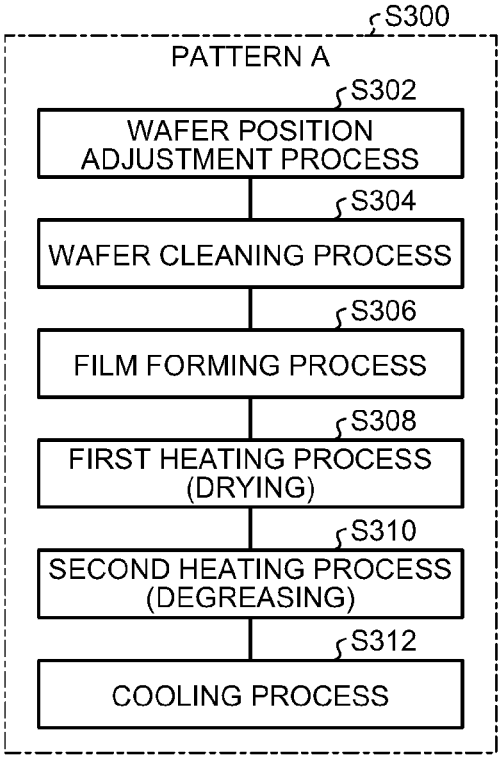
FIG. 11A is a schematic diagram illustrating a flow of processes of a pattern A performed by the droplet-discharging-head manufacturing apparatus of the embodiment.

In this case, when the film forming repetition number is other than the multiple of 3, the manufacturing apparatus 10 executes a series of processes of a pattern A illustrated in FIG. 11A. When the film forming repetition number is the multiple of 3, the manufacturing apparatus 10 executes a series of processes of a pattern B illustrated in FIG. 11B.

Figure 11B:
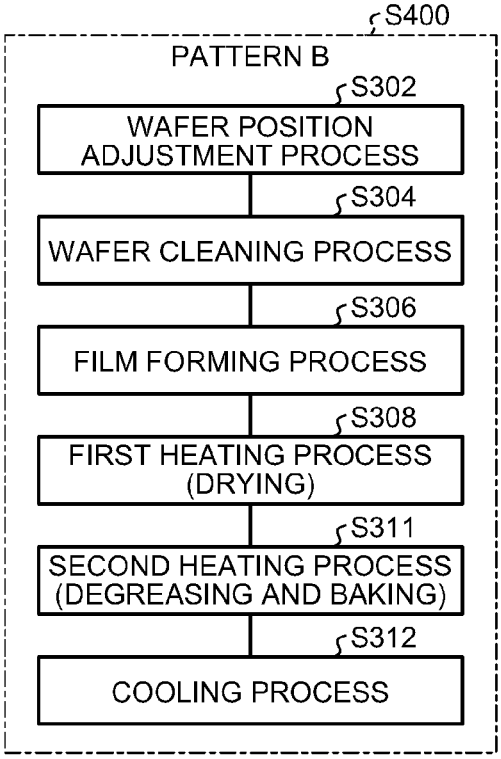
FIG. 11B is a schematic diagram illustrating a flow of processes of a pattern B performed by the droplet-discharging-head manufacturing apparatus of the embodiment.

Specifically, when the ferroelectric layer 61A corresponding to the film forming repetition number that is other than the multiple of 3 is formed, as illustrated in FIG. 11A, a series of processes S300, i.e., the wafer position adjustment process (Step S302), the wafer cleaning process (Step S304), the film forming process (Step S306), the drying process as the first heating process (Step S308), the degreasing process as the second heating process (Step S310), and the cooling process (at Step S312), is performed. When the ferroelectric layer 61A corresponding to the film forming repetition number that is the multiple of 3 is formed, as illustrated in FIG. 11B, a series of processes S400, i.e., the wafer position adjustment process (Step S302), the wafer cleaning process (Step S304), the film forming process (Step S306), the drying process as the first heating process (Step S308), the degreasing process and the baking process as the second heating process (Step S311), and the cooling process (Step S312), is performed.

Figure 11C:
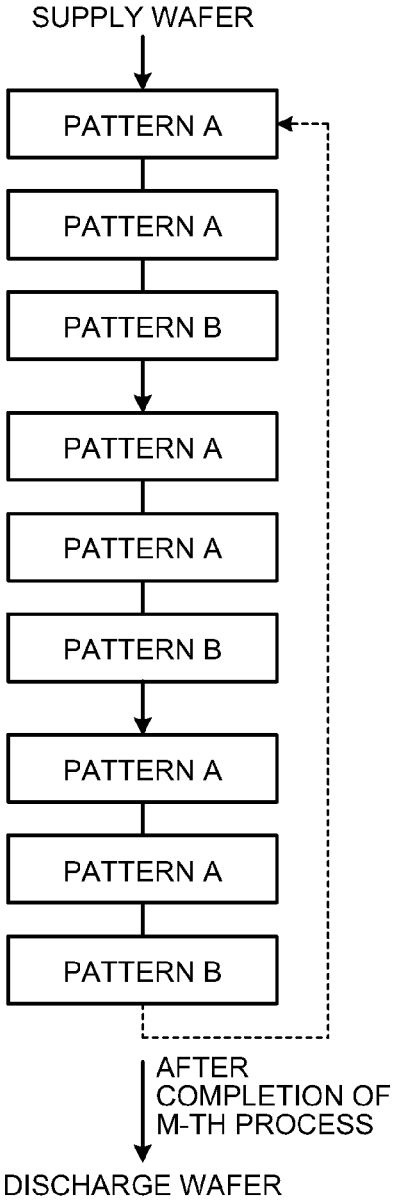
FIG. 11C is a schematic diagram of a flow of a process for forming a ferroelectric layer, which is performed by the droplet-discharging-head manufacturing apparatus of the embodiment.

As illustrated in FIG. 11C, it is possible to repeat a combination of two series of the processes of the pattern A and one series of the processes of the pattern B on one silicon wafer 50 until the topmost ferroelectric layer 61A is formed.

As described above, in the manufacturing apparatus 10 of the embodiment, each of the silicon wafers 50 is conveyed to the film forming unit 20 after the position adjusting unit 16 performs the position adjustment and the cleaning unit 18 cleans the silicon wafer 50. Therefore, the film forming unit 20 can stably form films.

Specifically, because the silicon wafer 50, the position of which has been adjusted, is conveyed to the film forming unit 20, it becomes possible to suppress occurrence of a positional deviation between a nozzle that discharges a ferroelectric precursor solution (sol) and the silicon wafer 50 at the time of film formation. Therefore, it is possible to suppress occurrence of the ferroelectric precursor solution discharged from the nozzle from being non-uniformly spread on the silicon wafer 50, enabling to prevent formation of a ferroelectric precursor film with an uneven thickness. Furthermore, because the silicon wafer 50, the position of which has been adjusted, is conveyed to the film forming unit 20, it is possible to suppress generation of mist at the time of film formation, enabling to prevent contamination on the surface of the silicon wafer 50 due to the mist.

The manufacturing apparatus 10 of the embodiment performs the interrupt process illustrated in FIG. 10 at regular time intervals as described above. Therefore, when no silicon wafer 50 is being formed in the film forming unit 20, the manufacturing apparatus 10 can take one new silicon wafer 50 out of the housing member 14, perform the position adjustment by the position adjusting unit 16, perform cleaning by the cleaning unit 18, and supply the silicon wafer 50 to the film forming unit 20. As a result, it is possible to reduce a down time of the manufacturing apparatus 10, enabling to sequentially form the ferroelectric layers 61A with efficiency.

It is preferable to configure the housing member 14 so as to house a certain number of the silicon wafers 50 that can be subjected to the series of the processes by the manufacturing apparatus 10 within a predetermined time. The predetermined time is, for example, 24 hours. By configuring the housing member 14 so as to house a certain number of the silicon wafers 50 that can be subjected to the series of the processes by the manufacturing apparatus 10 within the predetermined time, it becomes possible to easily manage, by time unit, the processing state of the silicon wafer 50 processed by the manufacturing apparatus 10.

The manufacturing apparatus 10 of the embodiment may include a display unit (not illustrated) that displays various images, in addition to the configuration described above. In this case, the display unit may be electrically connected to the main control unit 34. The main control unit 34 may display, on the display unit, the management number stored in the storage unit 38 and the information corresponding to the management number (e.g., the film forming repetition number or the cooling start time). With this configuration, it is possible to visually present the processing state of the silicon wafer 50 processed by the manufacturing apparatus 10 to a user.

Second Embodiment

An example of a droplet discharging device provided with the droplet discharging head 62 described above will be explained below with reference to FIG. 12 and FIG. 13.

Figure 12:
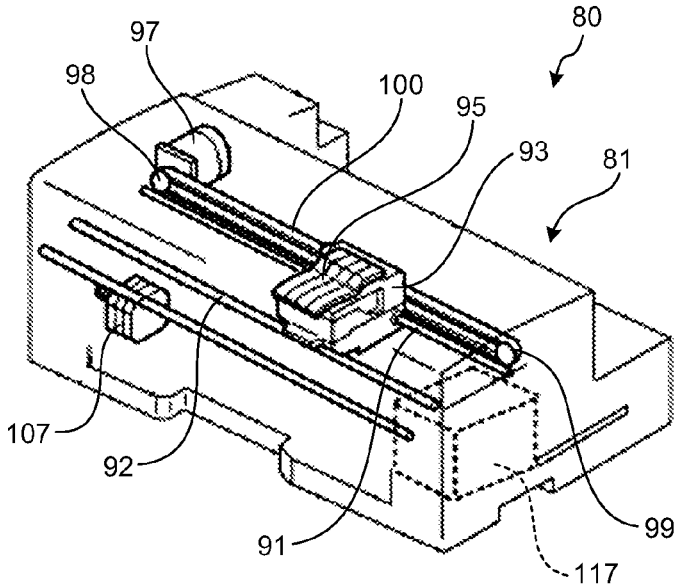
FIG. 12 is a schematic perspective view of an exemplary droplet discharging device provided with the droplet discharging head of the embodiment.
Figure 13:
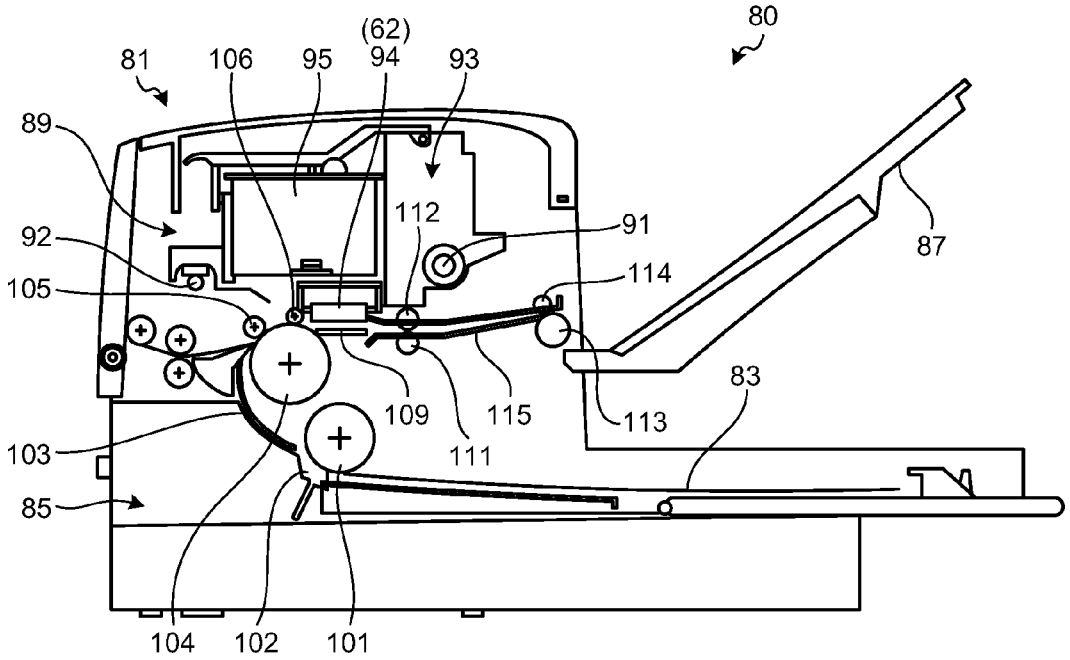
FIG. 13 is a schematic cross-sectional view of the exemplary droplet discharging device provided with the droplet discharging head of the embodiment.

As illustrated in FIG. 12 and FIG. 13, a droplet discharging device 80 houses a carriage 93 that is arranged inside an apparatus body 81 and that is movable in a main-scanning direction; a plurality of recording heads 94 that are mounted on the carriage 93 and that include the droplet discharging heads 62 described above; and a printing mechanism unit 89 that includes a plurality of ink cartridges 95 for supplying ink to the recording heads 94. A sheet feed cassette 85 (or a sheet feed tray), onto which a number of sheets 83 can be stacked from a front side of the apparatus body 81, may be detachably attached to the apparatus body 81. A manual feed tray (not illustrated) for manually feeding the sheets 83 may be opened for use. The sheet 83 fed from the sheet feed cassette 85 or the manual tray (not illustrated) is taken in, the printing mechanism unit 89 records a desired image on the sheet 83, and the sheet 83 is discharged to a discharge tray 87 that is attached to a rear side of the apparatus body 81.

In the printing mechanism unit 89, the carriage 93 is held by a main guide rod 91 and a sub guide rod 92, which are guide members that are laterally laid on right and left side plates (not illustrated), respectively, such that the carriage 93 can slide in the main-scanning direction. The recording heads 94 include droplet discharging heads, which are formed by the thin-film formation described above and which discharge ink droplets of different colors of yellow (Y), cyan (C), magenta (M), and black (Bk), respectively, and are mounted on the carriage 93 such that a plurality of ink discharge ports (nozzles) are arranged in a direction perpendicular to the main-scanning direction while the ink-droplet discharge direction corresponds to a downward direction. Ink cartridges 95 for supplying ink of different colors to the recording head 94 are mounted on the carriage 93 in a replaceable manner.

Each of the ink cartridges 95 includes an air hole for communicating with atmosphere at an upper portion thereof, a supply port for supplying ink to the inkjet head at a lower portion thereof, and a porous body filled with ink at an inner side thereof. Due to the capillary force of the porous body, ink supplied to the recording head 94 is maintained at slightly negative pressure. In the embodiment, heads for different colors are used as the recording heads 94; however, it may be possible to use a single head having nozzles for discharging ink droplets of different colors.

The rear side (a downstream side in a sheet conveying direction) of the carriage 93 is slidably engaged with the main guide rod 91, and the front side (an upstream side in the sheet conveying direction) of the carriage 93 is slidably placed on the sub guide rod 92. To cause the carriage 93 to move and scan in the main-scanning direction, a timing belt 100 is extended between a drive pulley 98 and a driven pulley 99 that are rotated by a main-scanning motor 97. The timing belt 100 is fixed to the carriage 93, and the carriage 93 is caused to reciprocate by normal rotation or reverse rotation of the main-scanning motor 97.

Meanwhile, in order to convey the sheet 83 set on the sheet feed cassette 85 to a portion below the recording head 94, the droplet discharging device 80 includes a sheet feed roller 101 and a friction pad 102 for separating and feeding the sheet 83 from the sheet feed cassette 85; a guide member 103 for guiding the sheet 83; a conveying roller 104 that inverts and conveys the fed sheet 83; and a tip roller 106 that prescribes an angle at which the sheet 83 is fed from the conveying roller 104 and a conveying roller 105 that is pressed against the circumferential surface of the conveying roller 104. The conveying roller 104 is rotated by a sub-scanning motor 107 via a gear train.

There is provided a print receiving member 109 that serves as a sheet guide member for guiding the sheet 83 fed from the conveying roller 104 on the lower side of the recording head 94 in accordance with a movement range of the carriage 93 in the main-scanning direction. On the downstream side of the print receiving member 109 in the sheet conveying direction, there are provided a conveying roller 111 that is rotated to convey the sheet 83 in the sheet discharging direction; a spur 112; sheet discharging rollers 113 and 114 for discharging the sheet 83 onto the sheet discharge tray 87; and a guide member 115 that forms a sheet discharge path.

At the time of recording, the recording heads 94 are driven in accordance with image signals while moving the carriage 93 in order to discharge ink droplets for recording one line on the sheet 83 being stopped, and then the sheet 83 is conveyed by a predetermined amount to record a next line. When a recording completion signal or a signal indicating that the trailing end of the sheet 83 reaches a recording region is received, the recording operation is terminated and the sheet 83 is discharged.

A recovery device 117 for recovering from a discharge failure of the recording heads 94 is disposed at a position out of the recording region on the right end side of the carriage 93 in the moving direction of the carriage 93. The recovery device 117 includes a cap unit, a suction unit, and a cleaning unit. While waiting for printing, the carriage 93 is moved to the recovery device 117 side and the recording heads 94 are capped by a capping unit, so that discharge port portions can be maintained in a wet state to prevent a discharge failure due to drying of ink. Furthermore, ink is discharged irrespective of recording during the recording in order to maintain the ink viscosity uniform at all of discharge ports, so that a stable discharging property can be maintained.

When a discharge failure occurs, the discharge ports (nozzles) of the recording heads 94 are sealed by the capping unit, the suction unit sucks out air holes or the like together with the ink from the discharge ports via a tube, and the cleaning unit removes ink or dusts adhered to the surfaces of the discharge ports, so that the discharge failure is recovered. The sucked ink is discharged to a waste ink tank (not illustrated) placed on a lower portion of the main body and is sucked by an ink absorber in the waste ink tank.

As described above, the droplet discharging device 80 of the embodiment includes the droplet discharging head 62 manufactured by the manufacturing apparatus 10. Therefore, the droplet discharging device 80 of the embodiment can obtain a stable discharging property and improve image quality.

It is possible to install the droplet discharging device 80 to various printing apparatuses. By installing the droplet discharging device 80 to the various printing apparatuses, it is possible to provide a printing apparatus that can ensure improved image quality.

According to the embodiment, it is possible to provide a droplet-discharging-head manufacturing apparatus, a droplet-discharging-head manufacturing method, a droplet discharging head, a droplet discharging device, and a printing apparatus capable of suppressing a variation in a discharging property due to a variation in the thermal history of a ferroelectric layer between droplet discharging heads.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A droplet-discharging-head manufacturing apparatus that manufactures a droplet discharging head that includes a piezoelectric element formed by a lower electrode, a piezoelectric body as a laminated body of a plurality of ferroelectric layers, and an upper electrode laminated in this order, the droplet-discharging-head manufacturing apparatus comprising:

a film forming unit that forms a ferroelectric precursor film on a silicon wafer having a conductive layer formed thereon;

a heating unit that heats and bakes the ferroelectric precursor layer to form the ferroelectric layer;

a cooling unit that cools the ferroelectric layer;

a conveying unit that conveys a plurality of the silicon wafers one by one; and a control unit that controls the film forming unit, the heating unit, the cooling unit, and the conveying unit so as to repeat a series of processes including formation of the ferroelectric precursor layers by the film forming unit, heating of the ferroelectric precursor layers by the heating unit, and cooling of the ferroelectric layers by the cooling unit, for a predetermined number of times for each of the silicon wafers, one wafer by one wafer, wherein each of the film forming unit, the heating unit and the cooling unit performs processing on the plurality of the silicon wafers one wafer at a time.

2. The droplet-discharging-head manufacturing apparatus according to claim 1, further comprising:

a reading unit that reads a management number for identifying each of the silicon wafers, the management number being formed on each of the silicon wafers; and a storage unit that stores therein the management number and information on a film forming repetition number indicating the number of times formation of the ferroelectric precursor layers has been repeated on each of the silicon wafers, in an associated manner, and that stores therein in advance a heating condition corresponding to the information on the film forming repetition number, wherein the control unit increments the information on the film forming repetition number associated with the management number of the silicon wafer every time the series of the processes is performed on the silicon wafer, and further controls the heating unit so that the heating unit heats the ferroelectric precursor films under the heating condition corresponding to the information on the film forming repetition number.

3. The droplet-discharging-head manufacturing apparatus according to claim 1, wherein the heating unit includes:

a first heating unit that heats the ferroelectric precursor films at a predetermined first temperature; and a second heating unit that heats the ferroelectric precursor films, which have been heated by the first heating unit, at a second temperature that is higher than the first temperature.

4. The droplet-discharging-head manufacturing apparatus according to claim 1, further comprising:

a housing unit that houses a plurality of silicon wafers, each of the silicon wafers including a conductive layer, wherein the film forming unit includes a detecting unit that detects whether there is no silicon wafer being formed by the film forming unit, and the control unit controls the conveying unit so that the conveying unit conveys one silicon wafer from the housing unit to the film forming unit when the detecting unit detects that there is no silicon wafer in the film forming unit.

5. The droplet-discharging-head manufacturing apparatus according to claim 4, wherein the housing unit houses a predetermined number of silicon wafers, and the silicon wafers are, one wafer by one wafer, subjected to the series of the processes within a predetermined time.

6. The droplet-discharging-head manufacturing apparatus according to claim 2, wherein the cooling unit further includes a holding unit that holds the silicon wafers, and the control unit stores a cooling start time, indicating a time at which each of the silicon wafers is conveyed to the cooling unit, in the storage unit in association with the management number of each of the silicon wafers, and controls the film forming unit, the heating unit, the cooling unit, and the conveying unit so that the series of the processes is performed on the silicon wafer that is associated with the management number corresponding to a predetermined elapsed time since the cooling start time.

7. The droplet-discharging-head manufacturing apparatus according to claim 3, wherein the cooling unit further includes a holding unit that holds the silicon wafers, and the control unit stores a cooling start time, indicating a time at which each of the silicon wafers is conveyed to the cooling unit, in the storage unit in association with the management number of each of the silicon wafers, and controls the film forming unit, the heating unit, the cooling unit, and the conveying unit so that the series of the processes is performed on the silicon wafer that is associated with the management number corresponding to a predetermined elapsed since the cooling start time.

8. The droplet-discharging-head manufacturing apparatus according to claim 4, wherein the cooling unit further includes a holding unit that holds the silicon wafers, and the control unit stores a cooling start time, indicating a time at which each of the silicon wafers is conveyed to the cooling unit, in the storage unit in association with the management number of each of the silicon wafers, and controls the film forming unit, the heating unit, the cooling unit, and the conveying unit so that the series of the processes is performed on the silicon wafer that is associated with the management number corresponding to a predetermined elapsed time since the cooling start time.

9. A droplet-discharging-head manufactured by the droplet-discharging-head manufacturing apparatus according to claim 1.

10. A droplet discharging device comprising the droplet discharging head according to claim 9, and a liquid supply unit configured to supply liquid to the droplet discharging head.

11. A printing apparatus comprising the droplet discharging device according to claim 10, a housing configured to house the droplet discharging device.

12. A droplet-discharging-head manufacturing method for manufacturing a droplet discharging head that includes a piezoelectric element formed by a lower electrode, a piezoelectric body as a laminated body of a plurality of ferroelectric layers, and an upper electrode laminated in this order, the droplet-discharging-head manufacturing method comprising:

(a) forming a ferroelectric precursor film on a silicon wafer having a conductive layer formed thereon;

(b) heating and baking the ferroelectric precursor layer to form the ferroelectric layer;

(c) cooling the ferroelectric layer; and repeating, for each of a plurality of silicon wafers, one wafer at a time, a series of processes in an order of (a) forming, (b) heating, and (c) cooling, for a predetermined number of times, one wafer by one wafer.

13. The droplet-discharging-head manufacturing apparatus according to claim 1, further comprising:

a position adjusting unit that adjusts a center position of the silicon wafer to a predetermined position and adjusts an orientation flat of the silicon wafer to a predetermined direction.

* * * * *